US009284774B2

(12) United States Patent
Yu et al.

(10) Patent No.: US 9,284,774 B2
(45) Date of Patent: Mar. 15, 2016

(54) WINDOW SHADE AND ACTUATING SYSTEM AND OPERATING METHOD THEREOF

(71) Applicant: TEH YOR CO., LTD., Taipei (TW)

(72) Inventors: Fu-Lai Yu, New Taipei (TW); Chin-Tien Huang, New Taipei (TW)

(73) Assignee: TEH YOR CO., LTD. (TW)

( * ) Notice: Subject to any disclaimer, the term of this patent is extended or adjusted under 35 U.S.C. 154(b) by 0 days.

(21) Appl. No.: 14/286,489

(22) Filed: May 23, 2014

(65) Prior Publication Data

US 2015/0007946 A1 Jan. 8, 2015

Related U.S. Application Data

(60) Provisional application No. 61/843,075, filed on Jul. 5, 2013.

(51) Int. Cl.

| | |
|---|---|
| ***E06B 9/322*** | (2006.01) |
| ***E06B 9/38*** | (2006.01) |
| ***E06B 9/262*** | (2006.01) |
| ***E06B 9/30*** | (2006.01) |
| E06B 9/32 | (2006.01) |
| *E06B 9/78* | (2006.01) |

(52) U.S. Cl.

CPC . *E06B 9/38* (2013.01); *E06B 9/262* (2013.01); *E06B 9/30* (2013.01); *E06B 9/322* (2013.01); *E06B 9/32* (2013.01); *E06B 2009/2627* (2013.01); *E06B 2009/3222* (2013.01); *E06B 2009/785* (2013.01)

(58) Field of Classification Search

CPC . E06B 9/304; E06B 9/322; E06B 2009/2627; E06B 2009/785

USPC ..... 160/168.1 R, 170

See application file for complete search history.

(56) References Cited

U.S. PATENT DOCUMENTS

| | | | | |
|---|---|---|---|---|
| 5,890,529 | A | 4/1999 | Haarer | |
| 6,752,194 | B1 * | 6/2004 | Huang | 160/168.1 R |
| 7,665,507 | B2 * | 2/2010 | Naoki | 160/308 |

(Continued)

FOREIGN PATENT DOCUMENTS

| | | | |
|---|---|---|---|
| CN | 1513406 | A | 7/2004 |
| CN | 102191908 | B | 1/2013 |

(Continued)

OTHER PUBLICATIONS

English Translation of Abstract from CN 1513406 A.

*Primary Examiner* — Blair M Johnson

(74) *Attorney, Agent, or Firm* — David I. Roche; Baker & McKenzie LLP

(57) ABSTRACT

An actuating system for a window shade comprises a transmission axle, a spring drive unit operable to urge the transmission axle to rotate in a first direction for raising a shading structure of the window shade, and a control module including an arrester assembled around the transmission axle, and an operating cord operatively connectable with the transmission axle. The arrester has a locking state in which the arrester acts against the spring drive unit to block a rotational displacement of the transmission axle in the first direction, and an unlocking state in which rotation of drive axle is allowed. The operating cord is operable to turn the arrester from the locking state to the unlocking state and to drive rotation of the transmission axle in a second direction opposite to the first direction for lowering the shading structure of the window shade.

22 Claims, 27 Drawing Sheets

(56) References Cited

U.S. PATENT DOCUMENTS

| | | | | |
|---|---|---|---|---|
| 8,356,653 | B2 * | 1/2013 | Fu-Lai et al. | 160/84.05 |
| 9,187,951 | B2 * | 11/2015 | Yu et al. | |
| 2004/0134627 | A1 * | 7/2004 | Huang | 160/170 |
| 2006/0191650 | A1 * | 8/2006 | Takebayashi | 160/320 |
| 2012/0048485 | A1 * | 3/2012 | Fu-Lai | E06B 9/322 160/331 |
| 2012/0267060 | A1 | 10/2012 | Anderson et al. | |
| 2013/0220561 | A1 * | 8/2013 | Yu | E06B 9/322 160/340 |
| 2013/0340951 | A1 * | 12/2013 | Yu et al. | 160/168.1 P |
| 2014/0216668 | A1 * | 8/2014 | Kim | 160/322 |
| 2015/0007946 | A1 * | 1/2015 | Yu et al. | 160/84.02 |

FOREIGN PATENT DOCUMENTS

| | | | |
|---|---|---|---|
| EP | 1707735 | A2 | 10/2006 |
| TW | 201208623 | A1 | 3/2012 |

* cited by examiner

WINDOW SHADE AND ACTUATING SYSTEM AND OPERATING METHOD THEREOF

CROSS-REFERENCE TO RELATED APPLICATION(S)

This application claims priority to U.S. Provisional Patent Application No. 61/843,075 filed on Jul. 5, 2013, which is incorporated herein by reference.

BACKGROUND

1. Field of the Invention

The present inventions relate to window shades, and control modules used for actuating window shades.

2. Description of the Related Art

Many types of window shades are currently available on the market, such as Venetian blinds, roller shades and honeycomb shades. The shade when lowered can cover the area of the window frame, which can reduce the amount of light entering the room through the window and provided increased privacy. Conventionally, the window shade is provided with an operating cord that can be actuated to raise or lower the window shade. In particular, the operating cord may be pulled downward to raise the window shade, and released to lower the window shade.

In a conventional construction of the window shade, the operating cord can be connected with a drive axle. When the operating cord is pulled downward, the drive axle can rotate to wind suspension cords for raising the window shade. When the operating cord is released, the drive axle can be driven to rotate in a reverse direction for lowering the window shade.

However, this conventional construction may require to use an increased length of the operating cord for window shades that have greater vertical lengths. The greater length of the operating cord may affect the outer appearance of the window shade. Moreover, there is the risk of child strangle on the longer operating cord. To reduce the risk of accidental injuries, the operating cord may be maintained at a higher position so that a young child cannot easily reach the operating cord. Unfortunately, when the operating cord is pulled downward to raise the window shade, the operating cord may still move to a lower position and become accessible for a child.

With respect to a regular user, the manipulation of longer operating cords may also be less convenient. For example, the longer operating cord may become entangled, which may render its operation difficult.

Therefore, there is a need for a window shade that is convenient to operate, safer in use and address at least the foregoing issues.

SUMMARY

The present application describes a window shade, an actuating system suitable for use with the window shade, and a method for operating the window shade. The construction of the actuating system can use a shorter length of an operating cord for lowering a shading structure of the window shade. The control module also includes an actuator that is easily operable to turn the actuating system from a locking state to an unlocking state, so that the actuating system can automatically raise a bottom part of the window shade.

In one embodiment, the actuating system comprises a transmission axle, a spring drive unit operable to urge the transmission axle to rotate in a first direction for raising a shading structure of the window shade, and a control module including an arrester assembled around the transmission axle, and an operating cord operatively connectable with the transmission axle. The arrester has a locking state in which the arrester acts against the spring drive unit to block a rotational displacement of the transmission axle in the first direction, and an unlocking state in which rotation of drive axle is allowed. The operating cord is operable to turn the arrester from the locking state to the unlocking state and to drive rotation of the transmission axle in a second direction opposite to the first direction for lowering the shading structure of the window shade.

In another embodiment, a method of operating the window shade is described. The method includes pulling the operating cord downward to cause the bottom part to move downward away from the head rail, and once the bottom part reaches a desired position, releasing the operating cord so that the cord drum driven by the spring rotates to wind the operating cord. In addition, the method can further includes rotating a stick to cause the bottom part to move upward toward the head rail.

At least one advantage of the window shades described herein is the ability to conveniently adjust the shade by respectively operating the operating cord and the actuator. The operating cord used for lowering the window shade has a shorter length, which can reduce the risk of child strangle. The window shade can also be easily raised by rotating the actuator.

DETAILED DESCRIPTION OF THE EMBODIMENTS

Figure 1:
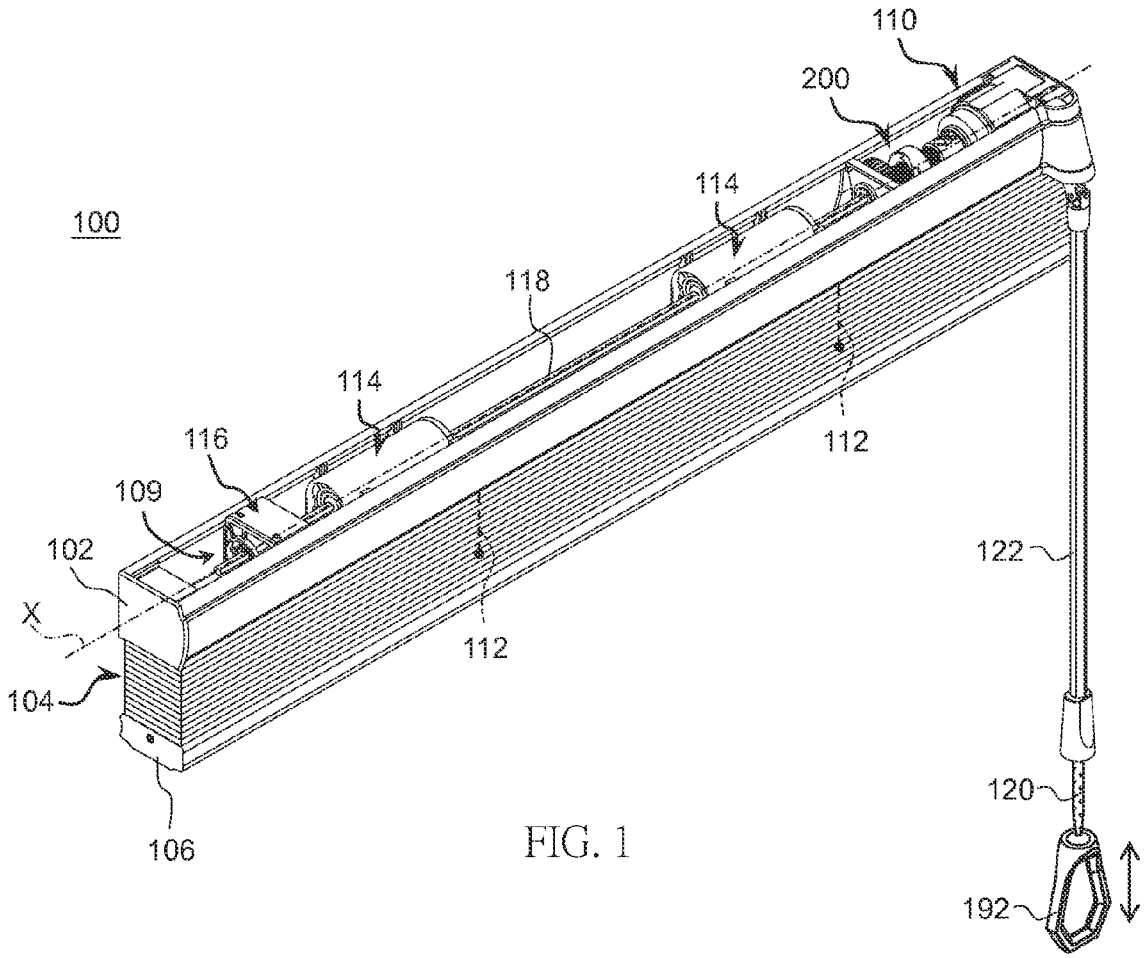
FIG. 1 is a perspective view illustrating an embodiment of a window shade.
Figure 2:
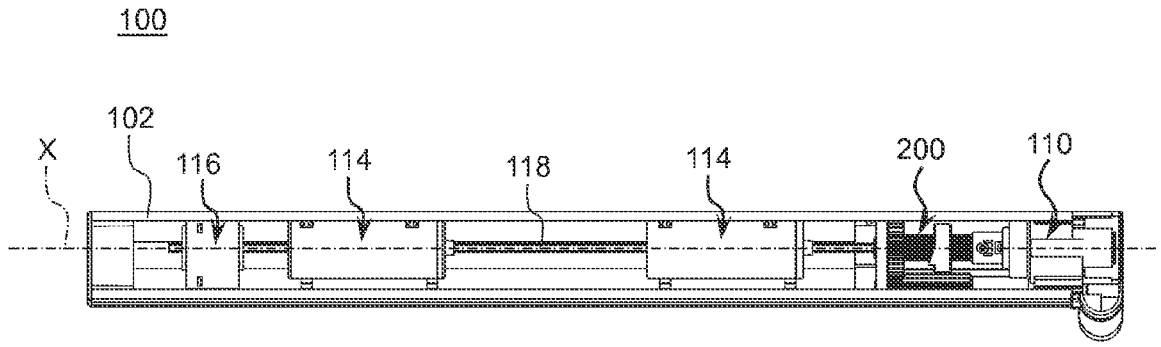
FIG. 2 is top view of the window shade shown in FIG. 1.

FIG. 1 is a perspective view illustrating an embodiment of a window shade 100, and FIG. 2 is a top view of the window shade 100. The window shade 100 can include a head rail 102, a shading structure 104, and a bottom part 106 disposed at a bottom of the shading structure 104. For driving upward and downward displacements of the shading structure 104 and the bottom part 106, the window shade 100 can further include an actuating system 109 comprised of a control module 110, a plurality of suspension cords 112 (shown with phantom lines), a plurality of cord winding units 114, one or more spring drive unit 116, a transmission axle 118, an operating cord 120, an actuator 122 and a limit mechanism 200.

Figure 3A:
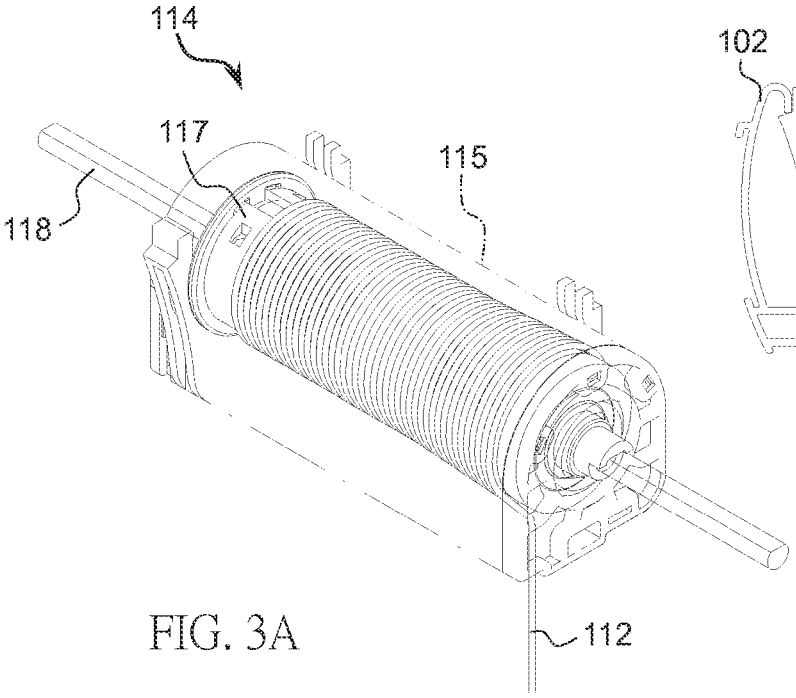
FIGS. 3A and 3B are schematic views illustrating a cord winding unit implemented in an actuating system of the window shade shown in FIG. 1.
Figure 3B:
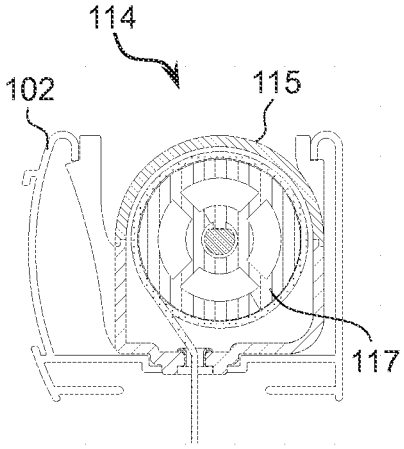

In conjunction with FIG. 1, FIGS. 3A and 3B are schematic views illustrating one cord winding unit 114. The cord winding unit 114 can include a casing 115 and a rotary drum 117. The casing 115 can be affixed with the head rail 102. The rotary drum 117 can be disposed in the casing 115, and can be assembled with the transmission axle 118. Each suspension cord 112 can be assembled between the head rail 102 and the bottom part 106, a first end portion of the suspension cord 112 being connected with the rotary drum 117 of one associated cord winding unit 114, and a second end portion of the suspension cord 112 being anchored with the bottom part 106. The rotary drum 117 and the transmission axle 118 can rotate in unison to either wind the suspension cord 112 for raising the bottom part 106, or unwind the suspension cord 112 for lowering the bottom part 106.

Figure 4A:
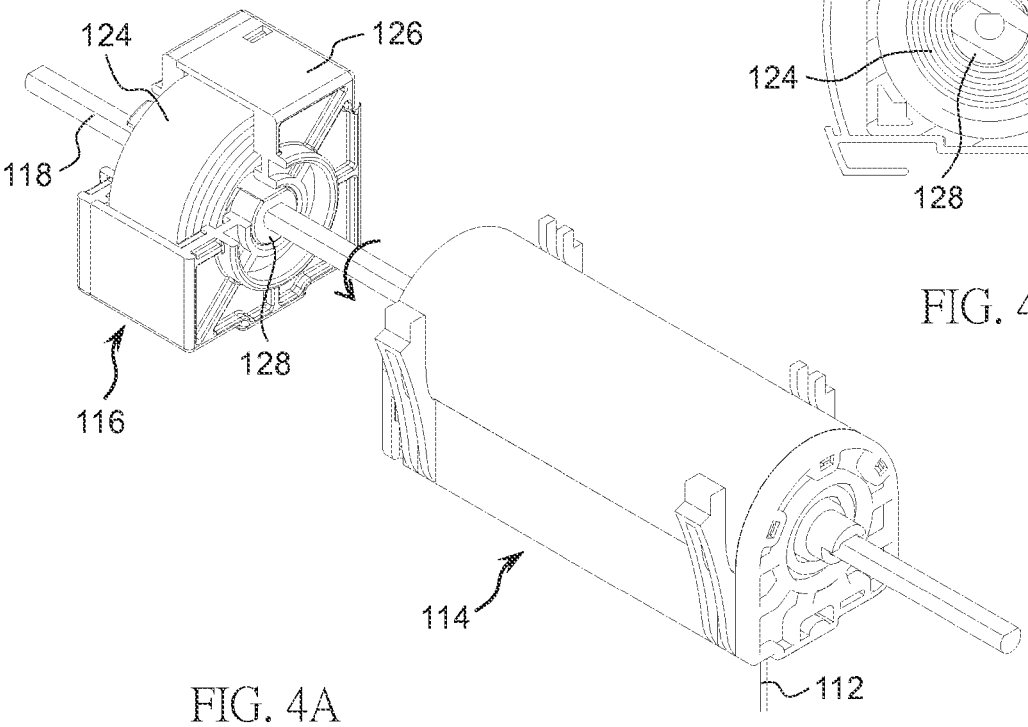
FIGS. 4A and 4B are schematic views illustrating the construction of a spring drive unit implemented in the actuating system of the window shade shown in FIG. 1.
Figure 4B:
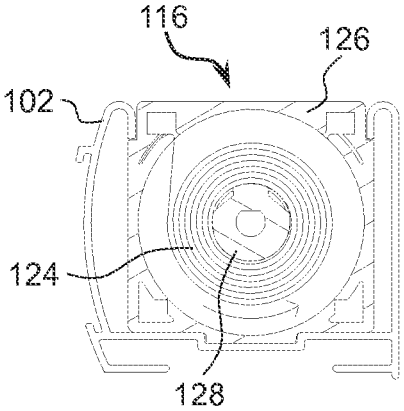

FIGS. 4A and 4B are schematic views illustrating the construction of the spring drive unit 116. The spring drive unit 116 can include a torsion spring 124 assembled around the transmission axle 118, and a fixed housing 126 enclosing the torsion spring 124. The torsion spring 124 can be arranged so as to rotate with the transmission axle 118. In particular, the torsion spring 124 can have one first end connected with the transmission axle 118, and a second end connected with the housing 126. For example, a joint sleeve 128 can be rotationally locked with the transmission axle 118, and the first end of the torsion spring 124 can be anchored with the joint sleeve 128. The torsion spring 124 can apply a spring force on the transmission axle 118 to urge the transmission axle 118 in rotation for winding the suspension cord 112 around the rotary drum 117 so as to raise the bottom part 106. In some embodiment, the spring drive unit 116 can be constructed separate from the cord winding unit 114. In other embodiments, the spring drive unit 116 can also be integrated into one cord winding unit 114 (e.g., by assembling the torsion spring 124 into the casing 115 of the cord winding unit 114) so as to form an integral unit.

For raising the bottom part 106, the actuator 122 can be rotated, which can turn the control module 110 from a locking state where it rotationally locks the transmission axle 118 to an unlocking state where the transmission axle 118 is allowed to rotate. While the control module 110 is in the unlocking state, the spring drive unit 116 then can drive the transmission axle 118 to rotate in a first direction, which in turn can drive concurrent rotation of the rotary drum 117 in each cord winding unit 114 to wind the corresponding suspension cord 112.

By pulling on the operating cord 120, the control module 110 can also be turned to the unlocking state. The pull action exerted by the operating cord 120 can further overcome the spring action of the spring drive unit 116 and drive rotation of the transmission axle 118 in a second direction opposite to the first direction, which in turn can drive rotation of the rotary drum 117 in each cord winding unit 114 to unwind the corresponding suspension cord 112 and expand the shading structure 104. The window shade 100 can thereby be turned to a closing or shading state. Exemplary construction and operation of the control module 110 will be described hereafter with reference to additional drawings.

Referring again to FIG. 1, various constructions may be applicable to make the shading structure 104. For example, the shading structure 104 may include a honeycomb structure made from a cloth material (as shown), a Venetian blind construction, or a plurality of rails or slats extending vertically and parallel to one another.

The head rail 102 may be of any types and shapes. The head rail 102 may be disposed at a top of the window shade 100 and configured to receive the assembly of the control module 110, the cord winding units 114, the spring drive unit 116, the transmission axle 118 and the limit mechanism 200. The bottom part 106 is disposed at a bottom of the window shade 100. In one embodiment, the bottom part 106 may be formed as an elongated rail. However, any types of weighing structures may be suitable. In some embodiment, the bottom part 106 may also be formed by a lowermost portion of the shading structure 104.

The transmission axle 118 can define a rotation axis X, and can be respectively connected with the control module 110, the cord winding units 114, the spring drive unit 116 and the limit mechanism 200. The displacement of the bottom part 106 is operatively connected with the rotation of the transmission axle 118, i.e., the rotation of the transmission axle 118 is operatively connected with the upward and downward movements of the bottom part 106.

The construction of the window shade 100 can be such that a user can pull on the operating cord 120 to lower and expand the shading structure 104. In one embodiment, the operating cord 120 can have a length that is shorter than a permitted total course of the bottom part 106. The user can repeatedly apply a sequence of pulling and release actions on the operating cord 120 to progressively lower the shading structure 104. For example, the overall length of the operating cord 120 can be smaller than half the height of the totally expanded shading structure 104. In another example, the length of the operating cord 120 can be one third of the height of the totally expanded shading structure 104, and the operating cord 120 can be repeatedly pulled about three times to entirely lower the shading structure 104. This process is similar to a ratcheting technique allowing the user to pull the operating cord 120 to lower the shading structure 104 a certain amount, allow the operating cord 120 to retract, and then pull the operating cord 120 again to continue to lower the shading structure 104. This process may be repeated until the shading structure 104 reaches a desired height.

Moreover, the actuator 122 can be operatively rotated to turn the control module 110 from the locking state to the release state to allow rotation of the transmission axle 118, such that the bottom part 106 can be raised by the spring action of the spring drive unit 116. When the actuator 122 is released, the control module 110 can turn from the release state to the locking state to block rotation of the transmission axle 118 and keep the bottom 106 stationary at any desired position.

Figure 5:
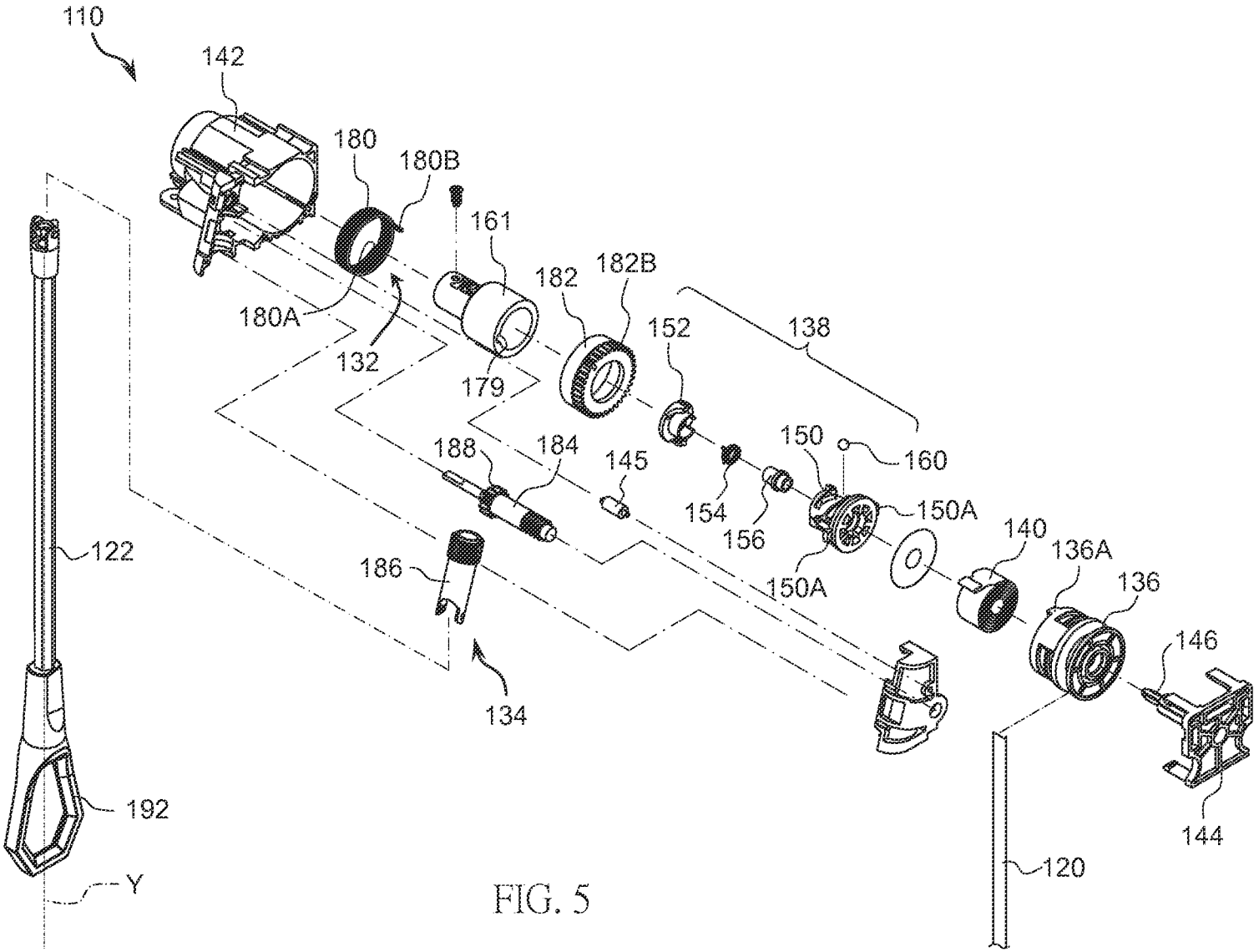
FIG. 5 is an exploded view illustrating an embodiment of a control module implemented in the actuating system of the window shade shown in FIG. 1.
Figure 6:
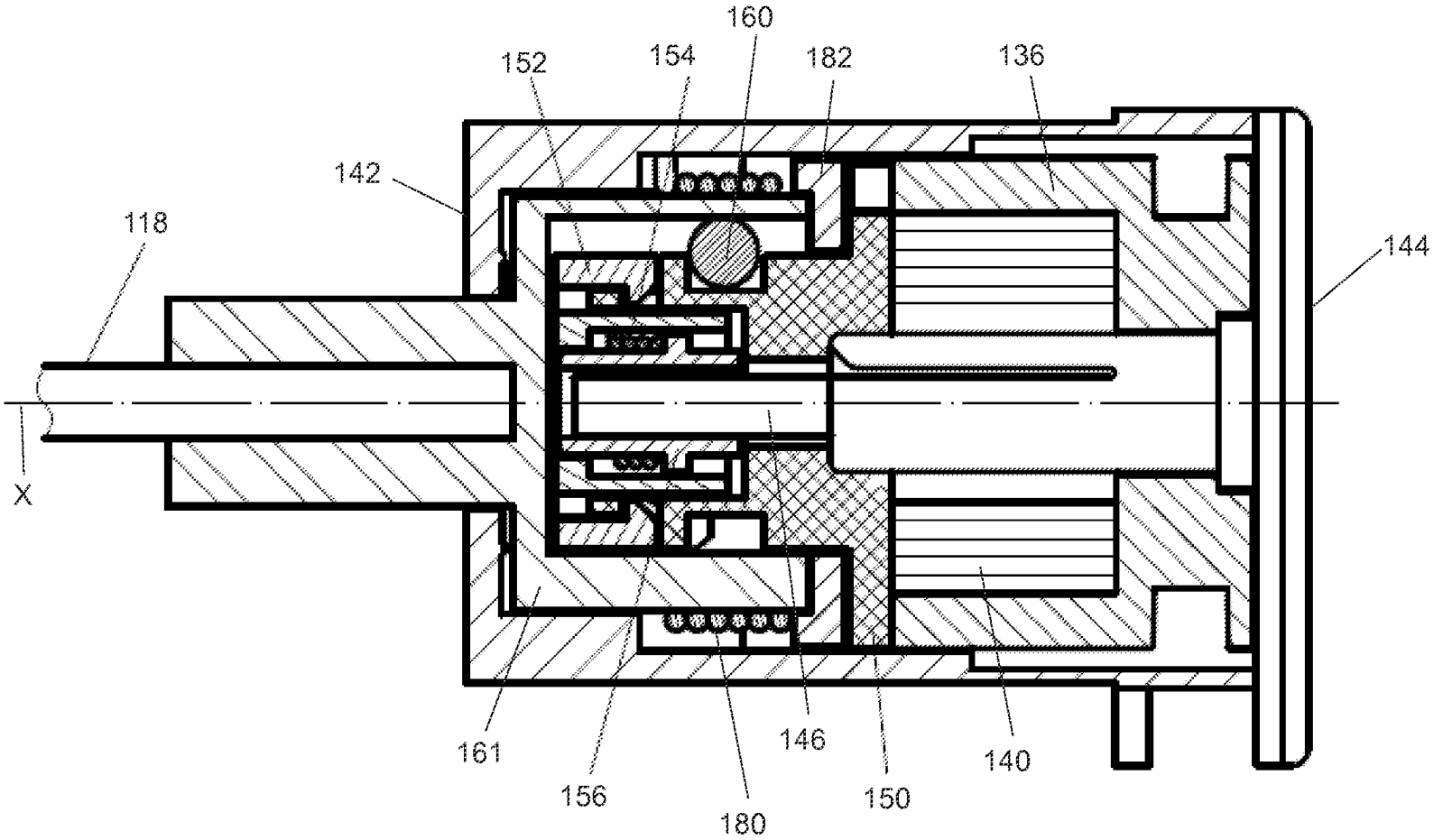
FIG. 6 is a cross-sectional view of the control module shown in FIG. 5.

FIGS. 5 and 6 are respectively exploded and cross-sectional views illustrating an embodiment of the control module 110. The control module 110 can include an arrester 132, a release unit 134, a cord drum 136 and a coupling and decoupling device 138. The arrester 132, the cord drum 136 and the coupling and decoupling device 138 can be disposed about a same axis coaxial to the transmission axle 118. The control module 110 can further include a spring 140 operable to drive rotation of the cord drum 136 in a direction for winding the operating cord 120. The spring 140 can be disposed inside (as shown) or outside the control module 110.

In addition, the control module 110 can include a housing 142 and a cover 144. The housing 142 and the cover 144 can be assembled together to form an enclosure in which the component parts of the control module 110 can be assembled. The cover 144 can have an inner side provided with a guide wheel 145 about which the operating cord 120 can be in contact and guided in sliding movement.

The coupling and decoupling device 138 can be operable to couple and decouple the movements of the cord drum 136 and the transmission axle 118. When the coupling and decoupling device 138 is in the decoupling state, the transmission axle 118 and the cord drum 136 can rotate relative to each other. For example, the cord drum 136 can remain stationary, and the transmission axle 118 can be driven in rotation by the spring drive unit 116 to raise the bottom part 106 and stack the shading structure 104 thereon. Alternatively, the transmission axle 118 can remain stationary, and the cord drum 136 can rotate to wind and take up the operating cord 120. By pulling on the operating cord 120, the coupling and decoupling device 138 can be turned to the coupling state. In the coupling state of the coupling and decoupling device 138, the cord drum 136 and the transmission axle 118 can rotate synchronously via movement transmission through the coupling and decoupling device 138 to lower the shading structure 104 and the bottom part 106.

The coupling and decoupling device 138 can be assembled about a fixed shaft 146 between the arrester 132 and the cord drum 136. In one embodiment, the coupling and decoupling device 138 can include a first coupling part 150, a second coupling part 152, a spring 154, a connection member 156 and a rolling part 160. The rolling part 160 can be exemplary a ball. The coupling and decoupling device 138 can further include a sleeve 161.

Referring to FIGS. 5 and 6, the connection member 156 can be affixed with the fixed shaft 146. The fixed shaft 146 can be spaced apart from the transmission axle 118. More specifically, the fixed shaft 146 can project from the cover 144 coaxial to the transmission axle 118. The first coupling part 150 can be pivotally connected with a portion of the fixed shaft 146, and the second coupling part 152 can be pivotally connected with the connection member 156. The first and second coupling parts 150 and 152 can rotate about the common axis of the transmission axle 118 and the fixed shaft 146 relative to the fixed shaft 146 to turn the coupling and decoupling device 138 to the coupling or decoupling state.

Figure 7:
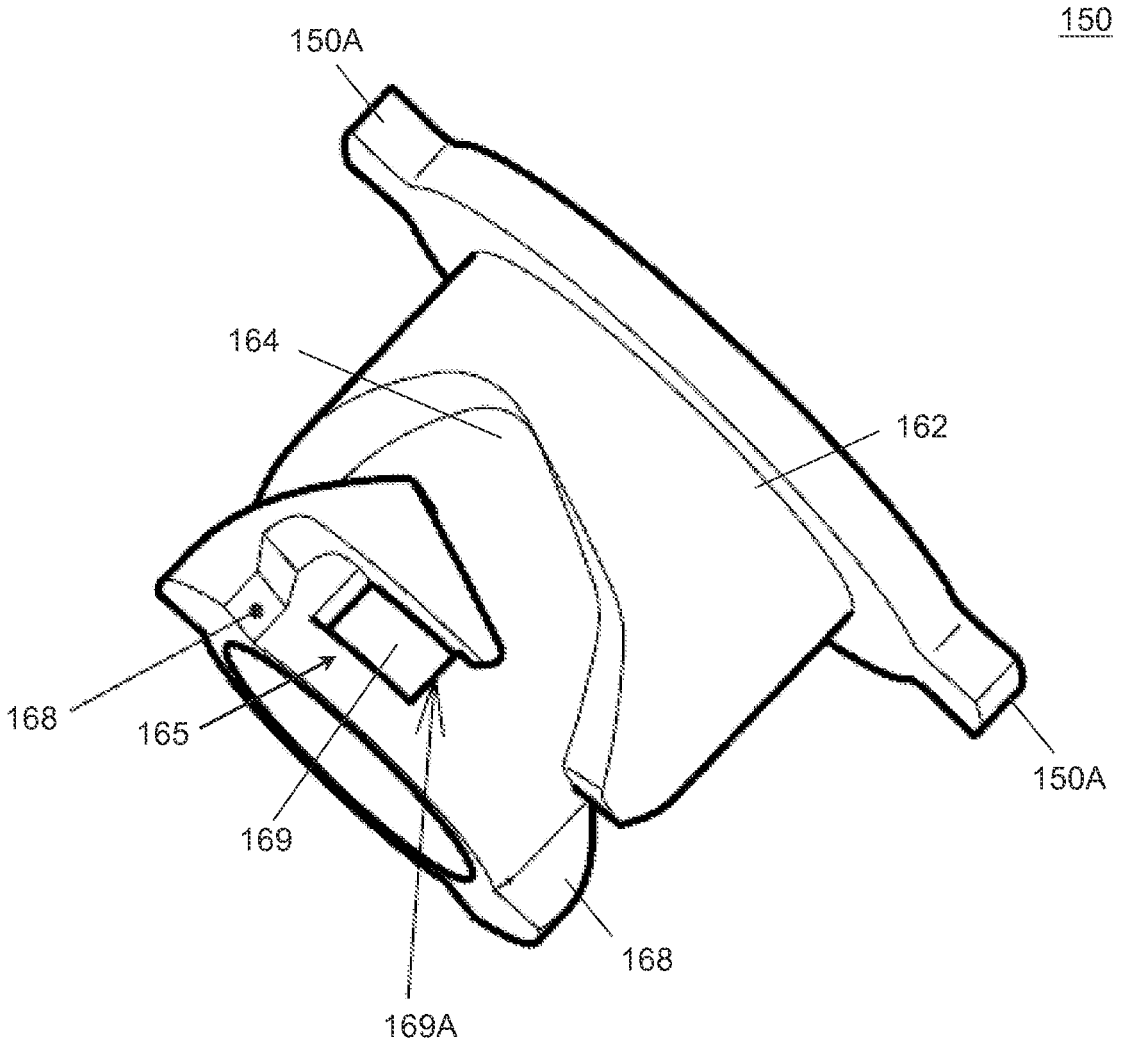
FIG. 7 is a perspective view illustrating a first coupling part of a coupling and decoupling device implemented in the control module.

Referring to FIG. 7, the first coupling part 150 can have a generally cylindrical shape, and mate with the second coupling part 152. More particularly, the first coupling part 150 can have an outer surface 162 of a cylindrical shape defined between two end portions. The outer surface 162 can include a recessed region that extends along the periphery of the first coupling part 150 and at least partially defines a guide track 164 of the coupling and decoupling device 138 and one or more notch 165 communicating with the guide track 164. In one embodiment, two notches 165 may be provided diametrically opposite to each other. The first coupling part 150 can have a first end portion near the cord drum 136 provided with two opposite radial flanges 150A. The cord drum 136 can contact with the radial flanges 150A, such that rotation of the cord drum 136 can drive the first coupling part 150 to rotate.

The first coupling part 150 can further have a second end portion near the second coupling part 152 provided with at least a radial abutment 168 that is located adjacent to the notch 165. In one embodiment, two radial abutments 168 can be provided at two opposite locations on the outer surface of the first coupling part 150 respectively adjacent to the notches 165. The first coupling part 150 can also include at least a slot 169 spaced apart from the radial abutments 168. In one embodiment, two slots 169 can be provided at diametrically opposite locations of the first coupling 150 respectively adjacent to the radial abutments 168.

Figure 8:
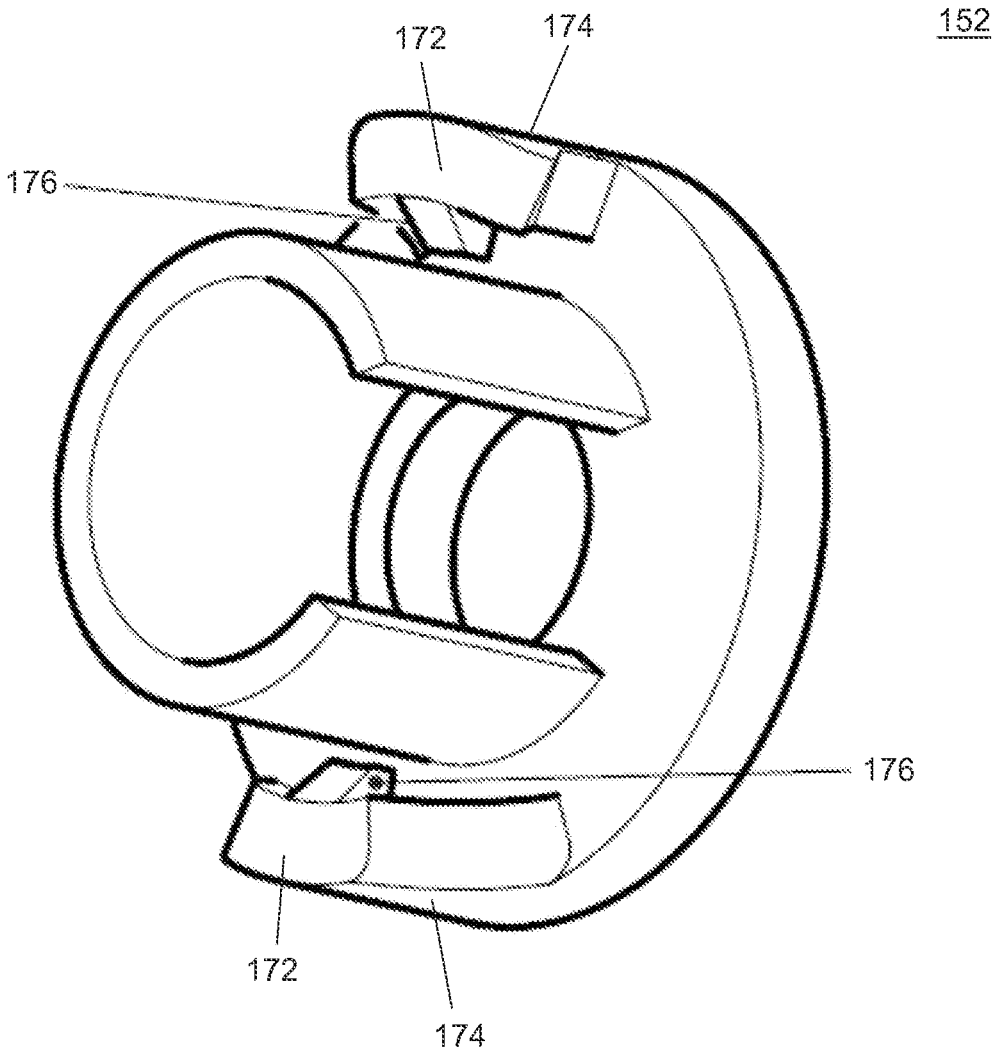
FIG. 8 is a perspective view illustrating a second coupling part of a coupling and decoupling device implemented in the control module.

Referring to FIG. 8, the second coupling part 152 can have a generally cylindrical shape, and can mate with the first coupling part 150. The second coupling part 152 can have two radial ribs 172 diametrically opposite to each other. Each radial rib 172 can have an outer surface 174 and an extension 176. The extension 176 can project radial from the radial rib 172 toward the center of the second coupling part 152.

Figure 15:
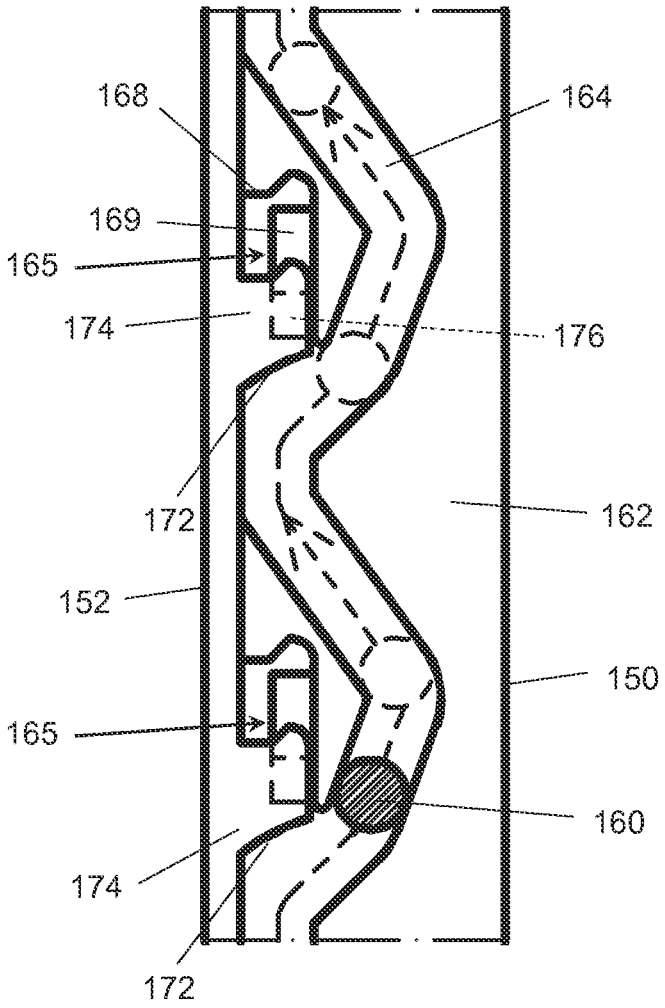
FIG. 15 is a schematic view illustrating a configuration of a guide track provided in the coupling and decoupling device when the window shade is raised.
Figure 22:
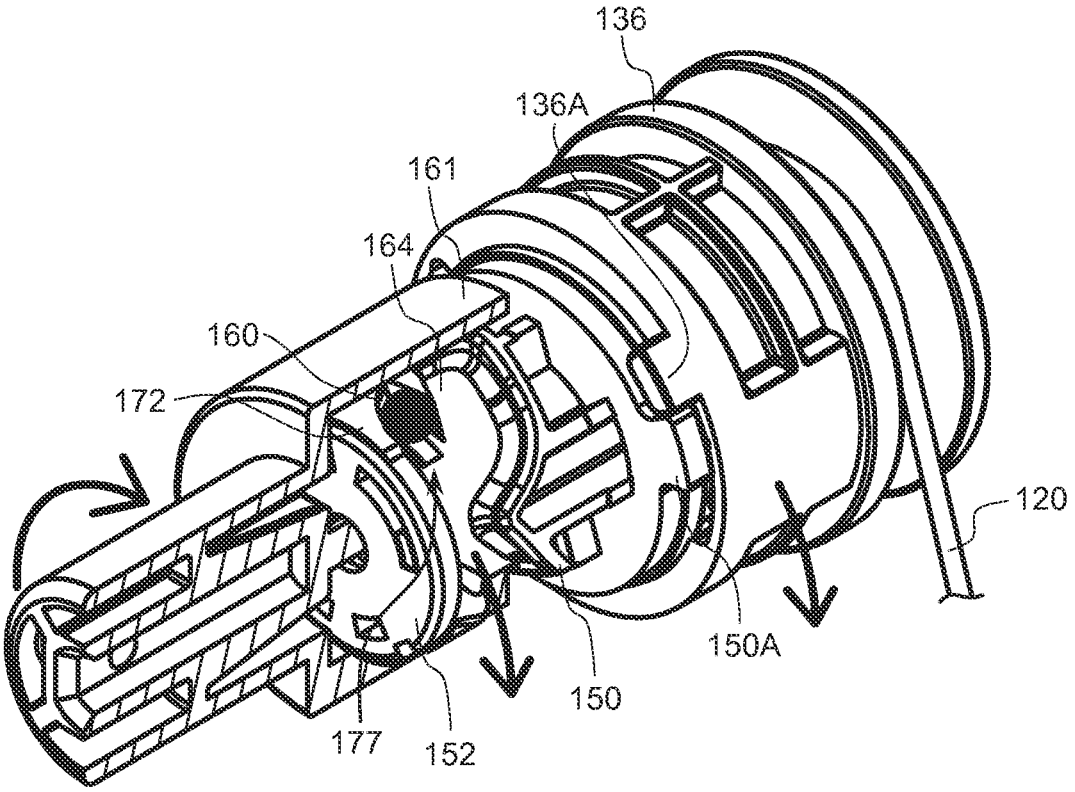
FIG. 22 is a schematic view illustrating a portion of the control module when the window shade lowers.

As shown in FIG. 15, after the first and second coupling parts 150 and 152 are assembled together, a closed guide track 164 can be formed between the outer surface 162 of the first coupling part 150 and the outer surface 174 of the second coupling part 152. The guide track 164 can peripherally run around the first and second coupling parts 150 and 152 and can be centered on the common axis of the transmission axle 118 and the fixed shaft 146. Each radial rib 172 can be movably disposed adjacent to one corresponding notch 165 of the first coupling part 150. The extension 176 can insert into one corresponding slot 169 to guide relative movement between the first and second coupling parts 150 and 152. Accordingly, the radial ribs 172 can move respectively in the notches 165 to form or remove a plurality of stop regions 177 in the path of the guide track 164 (as better shown in FIGS. 22 and 23).

Figure 9:
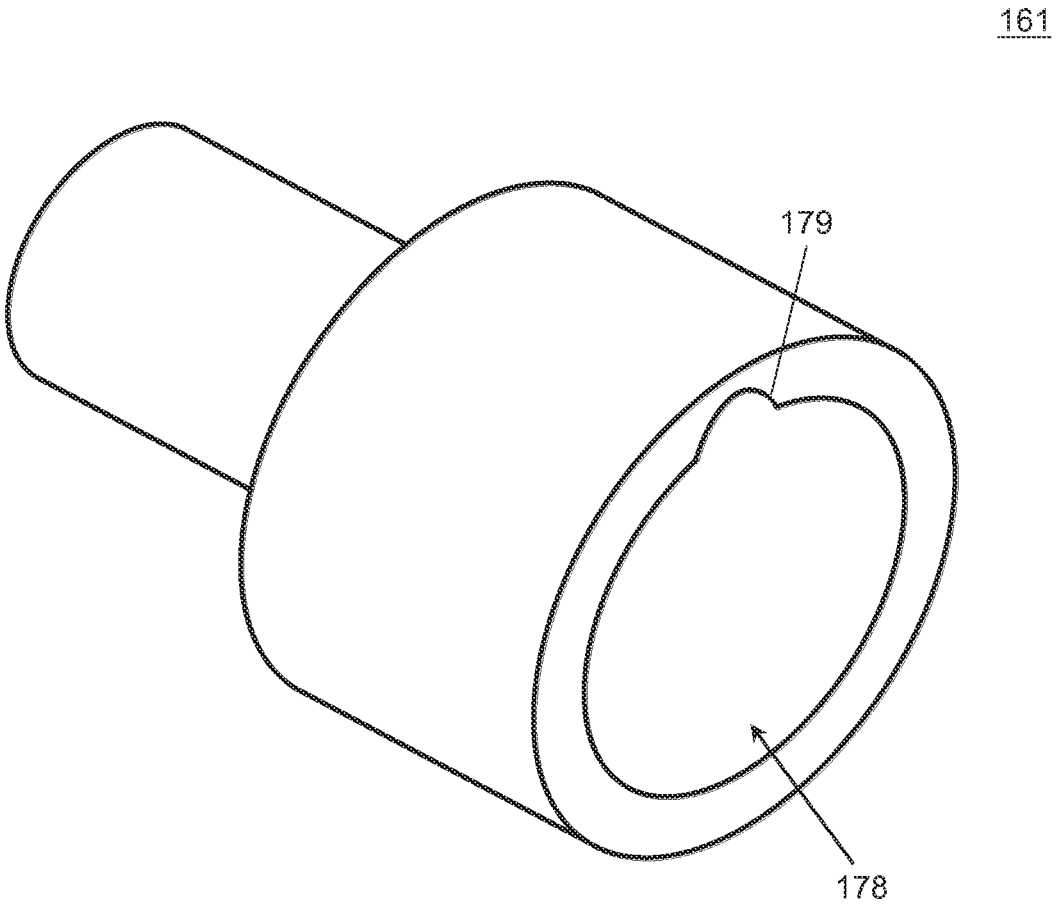
FIG. 9 is a perspective view illustrating a sleeve used in the control module and affixed with a transmission axle in the actuating system of the window shade.
Figure 10:
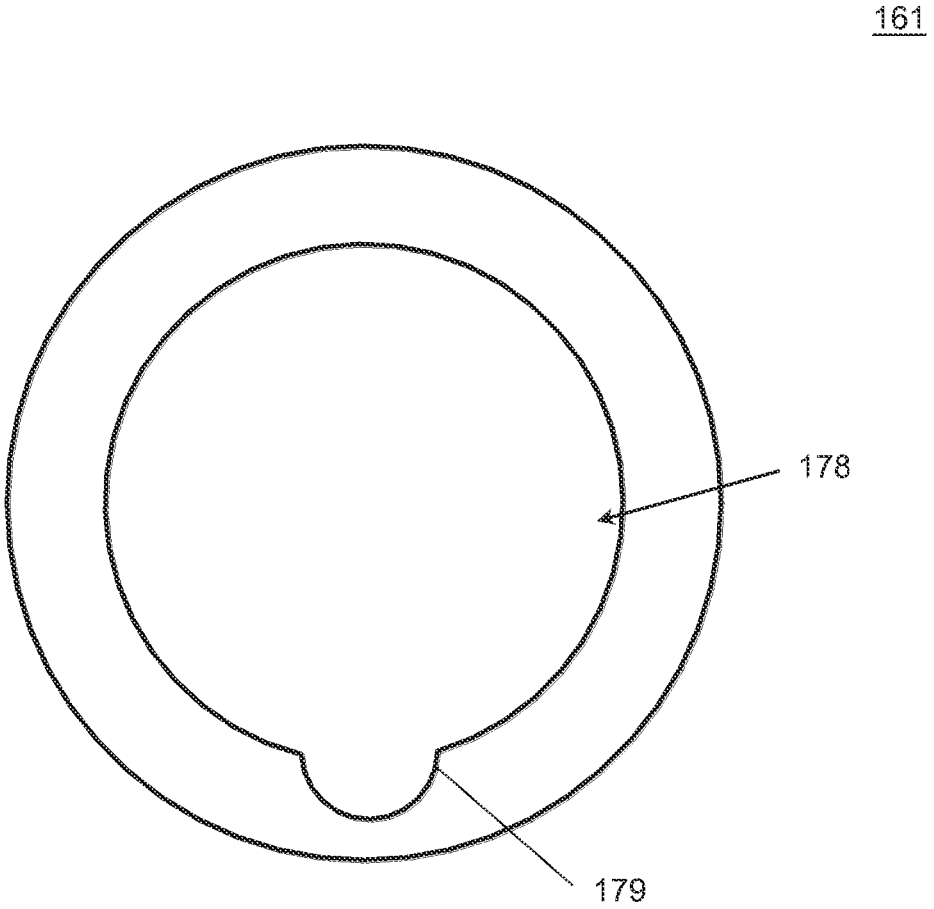
FIG. 10 is a front view of the sleeve shown in FIG. 9.

In conjunction with FIG. 5, FIGS. 9 and 10 are schematic views illustrating the sleeve 161. The sleeve 161 can be generally cylindrical in shape, and can be affixed with the transmission axle 118, such that the sleeve 161 can rotate along with the transmission axle 118. The sleeve 161 can include a central cavity 178 and a radial slot 179. The radial slot 179 can be formed in an inner sidewall of the central cavity 178, and can extend linearly parallel to the axis of the transmission axle 118. When the coupling and decoupling device 138 is assembled, the first and second coupling parts 150 and 152 can be disposed in the central cavity 178 of the sleeve 161, such that the guide track 164 can overlap at least partially with the length of the radial slot 179, and the rolling part 160 can be disposed in the guide track 164 and the radial slot 179 radially offset from the axis of the transmission axle 118.

When the coupling and decoupling device 138 is in the decoupling state, the relative positions of the first and second coupling parts 150 and 152 can be such that a rotation of the transmission axle 118 and the sleeve 161 independent from the cord drum 136 can cause the rolling part 160 to move along the radial slot 179 and the guide track 164 relative to the coupling parts 150 and 152 and the sleeve 161.

Figure 23:
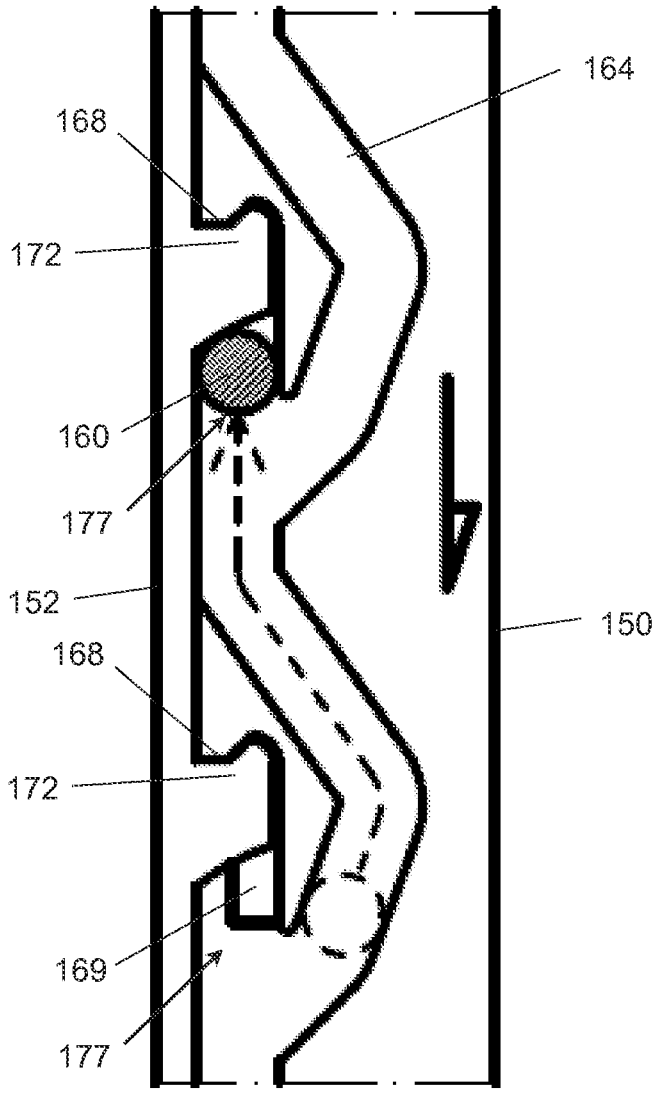
FIG. 23 is a schematic view illustrating a configuration of the guide track provided in the coupling and decoupling device when the window shade lowers.

When the coupling and decoupling device 138 is in the coupling state, the second coupling part 152 can rotationally displace to a second position relative to the first coupling part 150 so as to form the stop regions 177 of recessed shapes in the guide track 164. The stop regions 177 can be respectively formed as recesses at the areas of the notches 165, delimited by at least one sidewall of the guide track 164 (as shown in FIG. 23). Accordingly, the rolling part 160 can move along the guide track 164 and the radial slot 179, and then enter and stop in one stop region 177. As a result, the rotation of the cord drum 136 can be transferred via the first and second coupling parts 150 and 152 and through the restricted rolling part 160 to the sleeve 161 and the transmission axle 118. In some variant embodiments, the coupling and decoupling device 138 can also directly transfer the rotation from the cord drum 136 to the transmission axle 118.

In conjunction with FIG. 5, FIGS. 11-13 are schematic views illustrating the assembly of a portion of the control module 110. The cord drum 136 can have a generally cylindrical shape. The cord drum 136 can be pivotally connected with the fixed shaft 146, and can be disposed adjacent to a side of the first coupling part 150 opposite to the second coupling part 152. The cord drum 136 can be connected with the operating cord 120, such that a rotation of the cord drum 136 can wind the operating cord 120 thereon. An end portion of the cord drum 136 proximate to the first coupling part 150 can have at least one radial flange 136A. The radial flange 136A can contact with the flange 150A of the first coupling part 150 so as to drive rotation of the coupling and decoupling device 138.

Referring to FIGS. 5 and 6, the cord drum 136 can be coupled with the spring 140. The spring 140 can bias the cord drum 136 in rotation for winding the operating cord 120 around the cord drum 136. The spring 140 can be exemplary a torsion spring assembled in an inner cavity of the cord drum 136. The torsion spring can have a first end affixed with the fixed shaft 146, and a second end affixed with the cord drum 136. The cord drum 136 can be driven by the biasing action of the spring 140 to rotate relative to the fixed shaft 146 for winding the operating cord 120. In other embodiments, the spring 140 can be assembled outside the control module 110, and can be used to drive reverse rotation of the cord drum 136: in this case, while the spring 140 is spaced apart from the control module 110, it can still be connected with the cord drum 136 for driving its rotation to wind the operating cord 120.

Figure 11:
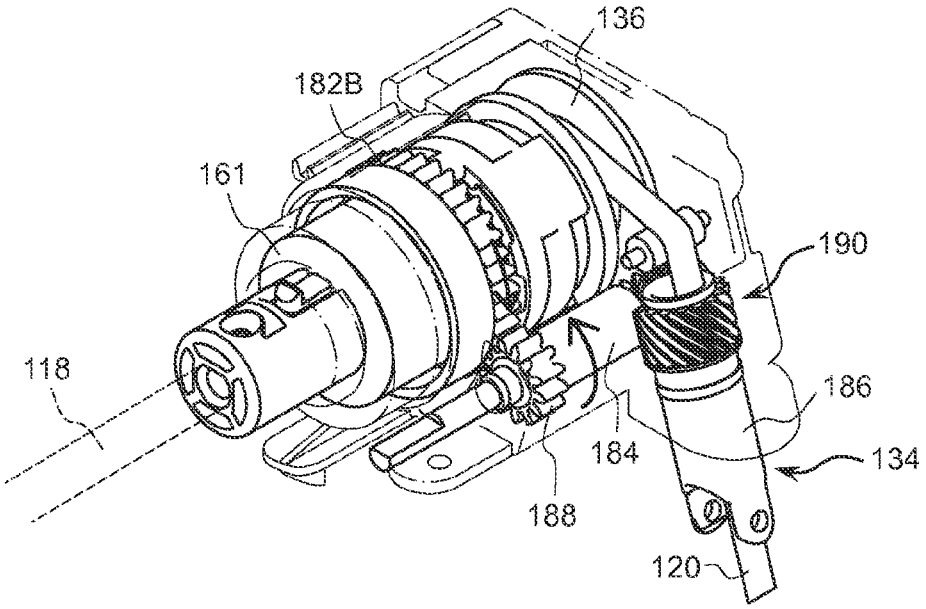
FIG. 11 is a schematic view illustrating the control module in an assembled state.
Figure 12:
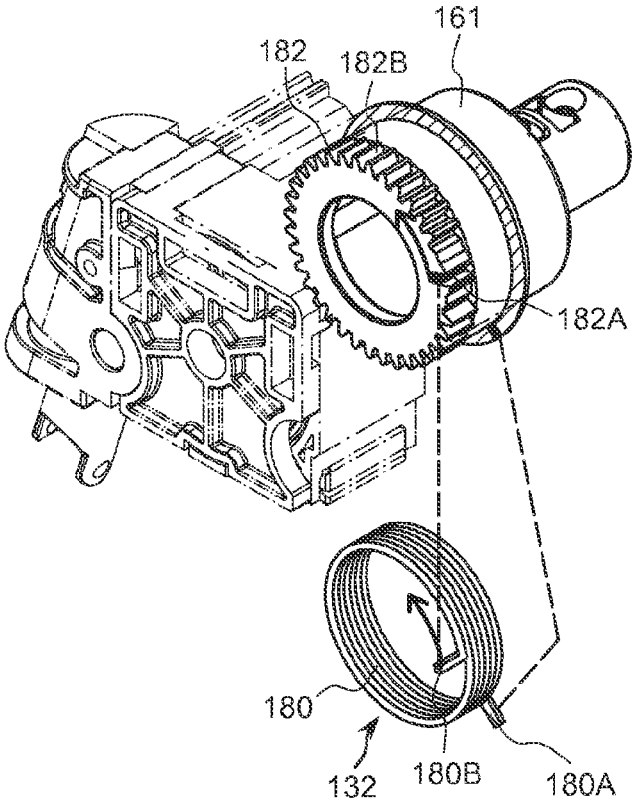
FIG. 12 is a schematic view illustrating the assembly of an arrester in the control module.
Figure 13:
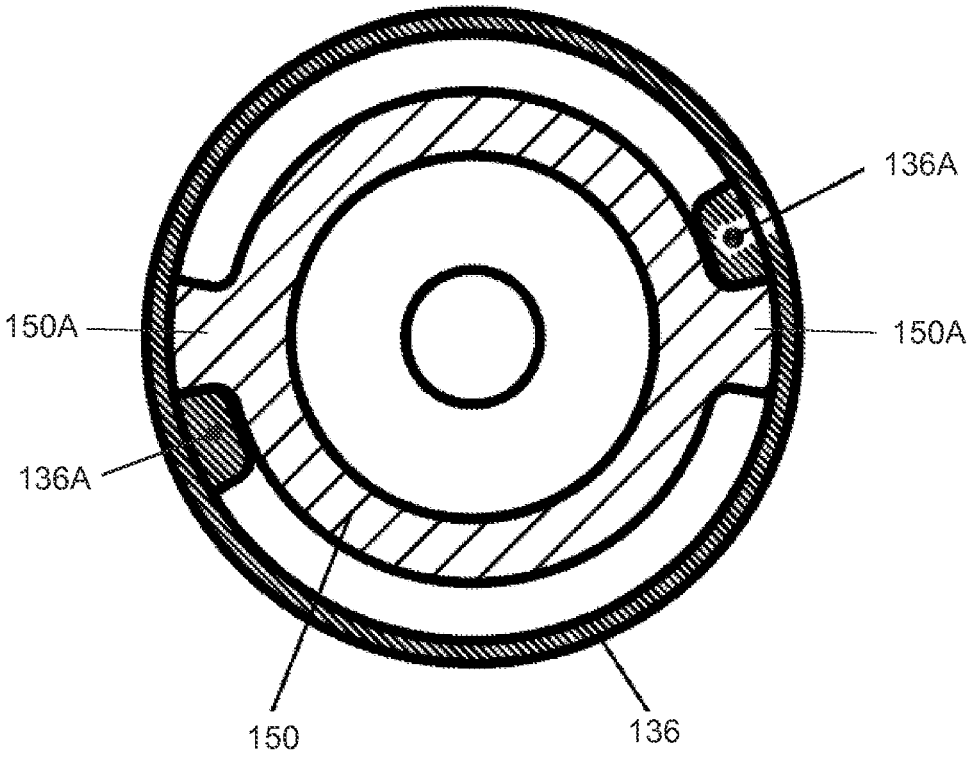
FIG. 13 is a schematic view illustrating the interaction between a cord drum and the first coupling part in the control module.
Figure 14:
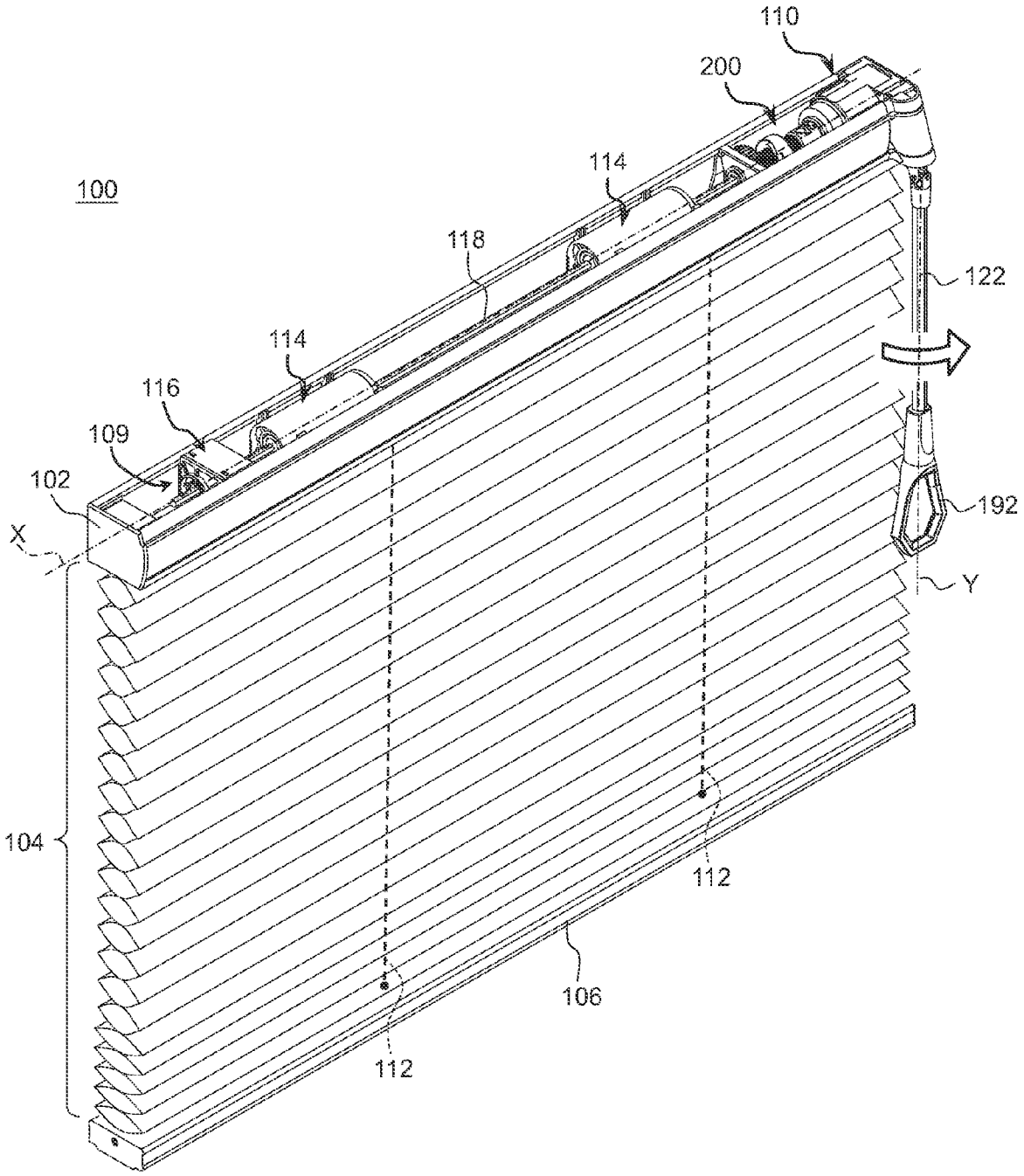
FIG. 14 is a schematic view illustrating an operation for raising the window shade.

Referring to FIGS. 5, 11 and 12, the arrester 132 can be assembled around the transmission axle 118, and can have a locking state and an unlocking or release state. In one embodiment, the arrester 132 can include a spring 180, e.g., a wrapping spring. The spring 180 can have a cylindrical shape, and can wrap on a peripheral surface of the sleeve 161. The spring 180 can include first and second prongs 180A and 180B. The first prong 180A can be affixed with the housing 142, and the second prong 180B can be affixed with a collar 182. The spring 180 can tighten on the sleeve 161 in the locking state, and loosen in the unlocking state. In the locking state, the arrester 132 can tighten on the sleeve 161 to lock the sleeve 161 and the transmission axle 118 in position. Rotation of the sleeve 161 and transmission axle 118 can be thereby blocked, and the shading structure 104 and the bottom part 106 can be held at a desired position. In the unlocking or release state, the arrester 132 can relax and allow rotation of the sleeve 161 and the transmission axle 118, so that the shading structure 104 and the bottom part 106 can be either raised by the spring drive unit 116 or lowered by the pulling action of the operating cord 120.

The release unit 134 can be connected with the arrester 132, and can be operable to drive the arrester 132 to switch from the locking state to the unlocking state. In one embodiment, the release unit 134 can include a collar 182, transmission members 184 and 186 and the actuator 122. The collar 182 can have a circular shape. However, other shapes may be suitable, e.g., a semicircular shape, a curved shape, and the like. The collar 182 can be pivotally assembled between the sleeve 161 and the cord drum 136, more particularly between the sleeve 161 and the first coupling part 150. The collar 182 can rotate about the rotation axis X of the transmission axle 118. The collar 182 can also be formed with a hole 182A and a peripheral toothed portion 182B. The second prong 180B of the spring 180 can pass through the hole 182A to affix with the collar 182.

The transmission members 184 and 186 are rotary transmission parts that can have different and unparallel pivot axes, and can be assembled as a transmission chain between the collar 182 and the actuator 122. In one embodiment, the transmission members 184 and 186 can have spaced-apart pivot axes that are substantially perpendicular to each other. The pivot axis of the transmission member 184 can be substantially parallel to the axis of the transmission axle 118, and the pivot axis of the transmission member 186 can be inclined relative to a vertical axis. The transmission member 184 can have a first portion provided with teeth 188 that can engage with the toothed portion 182B of the collar 182. A second portion of the transmission member 184 can engage with the transmission member 186 via a gear transmission 190. Examples of the gear transmission 190 can include a helicoid gear, a worm gear, and the like.

In one embodiment, the transmission member 186 can have a hollow body. The operating cord 120 can extend from the cord drum 136, travel through the transmission member 186, and be routed through an interior of the actuator 122. The operating cord 120 can thereby move relative to the actuator 122, e.g., the operating cord 120 when pulled downward can slide along its hollow interior relative to the actuator 122.

Referring to FIGS. 1, 5, 12 and 13, the actuator 122 can have an elongated shape that extends vertically downward from the head rail 102. For example, the actuator 122 can be formed as a hollow wand or stick. The actuator 122 can be assembled at one side of the head rail 102, and can be operatively connected with the arrester 132 via the collar 182 and the transmission members 184 and 186. The operating cord 120 can extend along the interior of the actuator 122, and have a lower end connected with a plug 192. The plug 192 can abut against a lower end of the actuator 122 so as to limit upward displacement of the operating cord 120 relative to the actuator 122. The actuator 122 can have an upper end pivotally connected with the transmission member 186 (e.g., through a transversal pivot shaft), so that the actuator 122 can rotate relative to the transmission member 186 for adjusting the inclination of the actuator 122. Moreover, the actuator 122 can rotate about its lengthwise axis Y to drive rotation of the transmission members 184 and 186, which in turn can drive the arrester 132 to switch from the locking state to the unlocking state.

The actuator 122 can rotate about its lengthwise axis Y to drive a rotational displacement of the collar 182 about the rotation axis X of the transmission axle 118 via the transmission members 184 and 186, which in turn causes a displacement of the second prong 180B for loosening the spring 180. The arrester 132 can thereby switch from the locking state to the unlocking state.

When the operating cord 120 is not manipulated by a user, the spring 180 can tighten around the sleeve 161 to block rotation of the transmission axle 118 against the lifting action applied by the spring drive unit 116. The locking state of the arrester 132 thereby counteracts the lift action of the spring drive unit 116 to keep the shading structure 114 at a stationary position. It is worth noting that the sleeve 161 can be formed as any part of any shape that is assembled with the transmission axle 118 and can operatively connect with the coupling and decoupling device 138, and should not be limited to elements mounted with the transmission axle 118. In other embodiments, the sleeve 161 can also be formed integral with the transmission axle 118, and the spring 180 can tighten on the transmission axle 118 to block its rotation.

Figure 16:
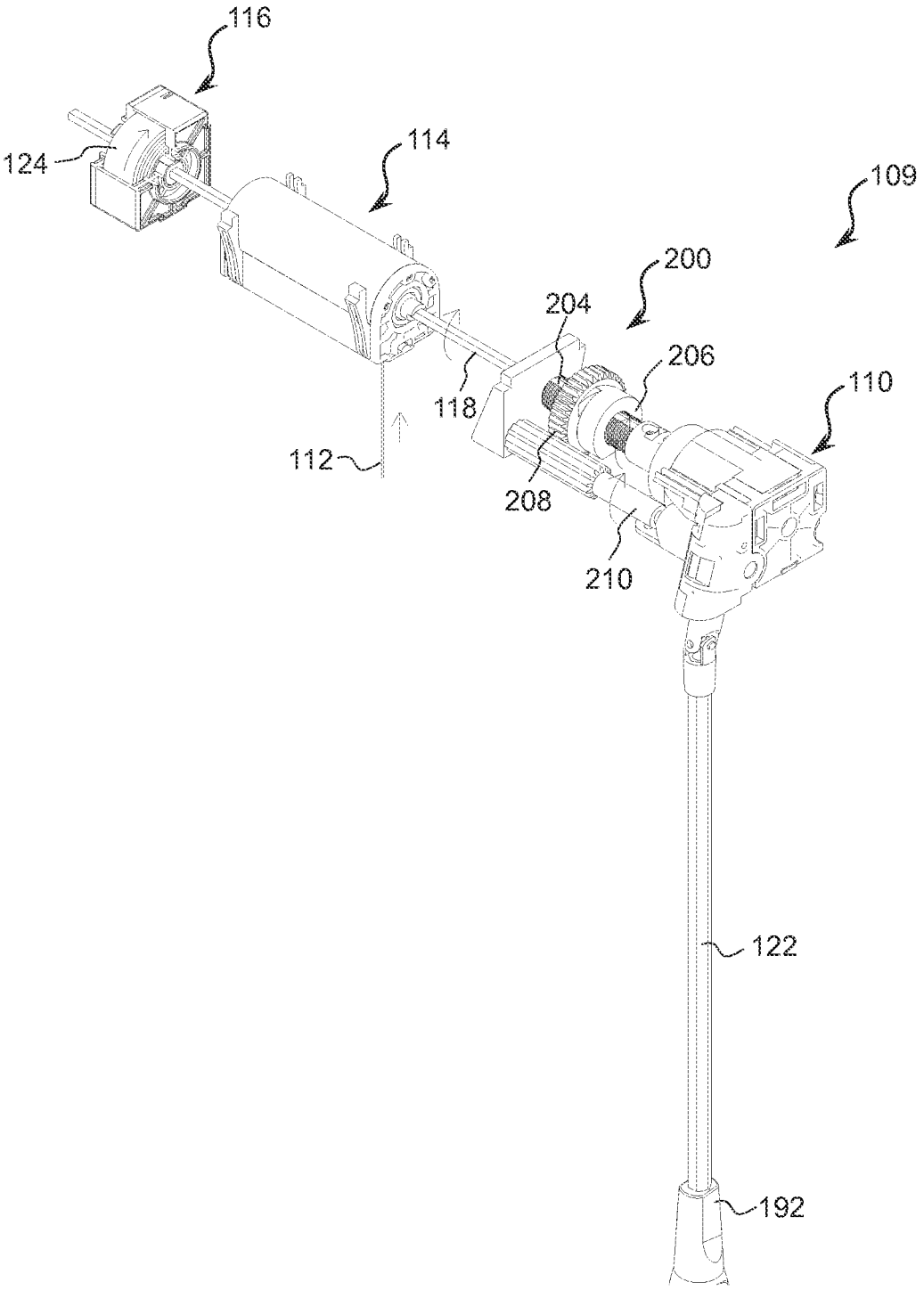
FIG. 16 is a schematic view illustrating movements taking place in the actuating system when the window shade is raised.
Figure 17:
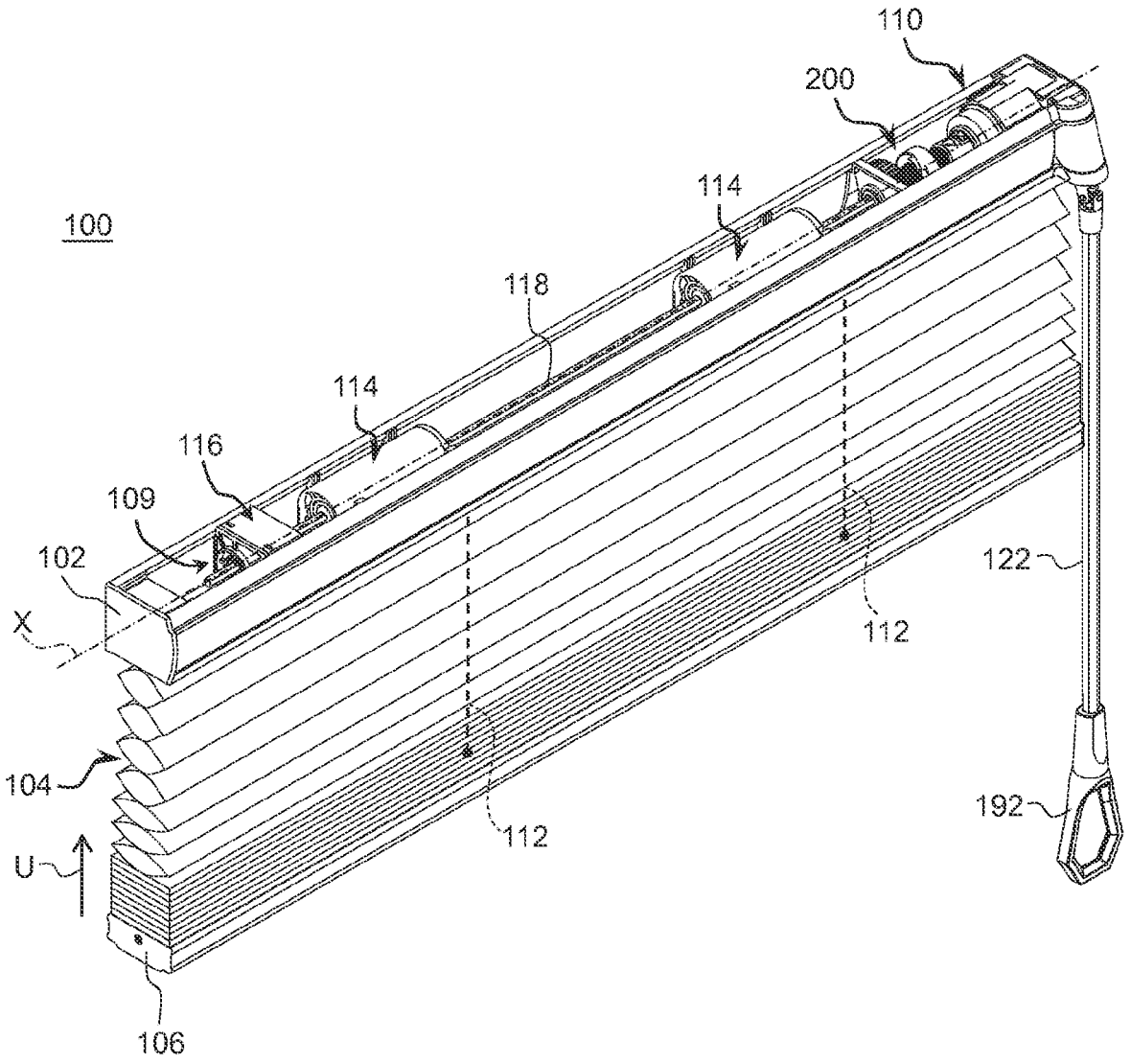
FIG. 17 is a perspective view illustrating the window shade continuously raising when the actuator is kept in the unlocking state.

In conjunction with FIGS. 1-13, FIG. 14 is a schematic view illustrating an operation for raising the window shade 100, FIG. 15 is a schematic view illustrating a configuration of the guide track 164 in the coupling and decoupling device 138 while the window shade 100 is raised, and FIG. 16 is a schematic view illustrating movements taking place in the actuating system 109 when the window shade 100 is raised. When the bottom part 106 is to be raised, the actuator 122 can be gently rotated about 90 degrees about its lengthwise axis Y to unlock the arrester 132 as described previously. Once the arrester 132 is switched to the unlocking state, the spring action applied by the spring drive unit 116 can overcome the total weight of the bottom part 106 and the shading structure 104 stacked thereon and drive the transmission axle 118 and the sleeve 161 to rotate in a first direction relative to the cord drum 136. This rotation of the transmission axle 118 can in turn drive rotation of the rotary drum 117 in each cord winding unit 114 to wind each corresponding suspension cord 112. While the transmission axle 118 and the sleeve 161 rotate for raising the bottom part 106, the cord drum 136 can be kept stationary, and the rolling part 160 can roll and move along the radial slot 179 and the guide track 164 relative to the sleeve 161 and the first and second coupling parts 150 and 152, as shown by the arrow in FIG. 15. In particular, when the bottom part 106 rises, the spring 154 can produce frictional resistance to keep the first and second coupling parts 150 and 152 stationary, whereby the coupling and decoupling device 138 can be maintained in the decoupling state (i.e., no stop regions 177 are formed in the guide track 164). Moreover, while the coupling and decoupling device 138 is in the decoupling state, the radial rib 172 of the second coupling part 152 is spaced apart from the radial abutment 168 that is located in one notch 165 of the first coupling part 150. As long as the actuator 122 is kept in the unlocking state, the shading structure 104 and the bottom part 106 can automatically and continuously rise driven by the spring drive unit 116, as illustrated by the upward arrow U in FIG. 17.

When the bottom part 106 moving upward reaches a desired height, the actuator 122 can be released. As a result, the spring 180 can elastically recover its tightening state around the sleeve 161, which can cause the arrester 132 to turn to the locking state to block rotation of the transmission axle 118 and the sleeve 161 against the lifting action of the spring drive unit 116. Accordingly, the bottom part 106 can be locked at the desired height. While the spring 180 is recovering its tightening state, the collar 182 can also rotate in an opposite direction, which can drive the actuator 122 to reversely rotate to its initial position via the transmission members 184 and 186.

Figure 18:
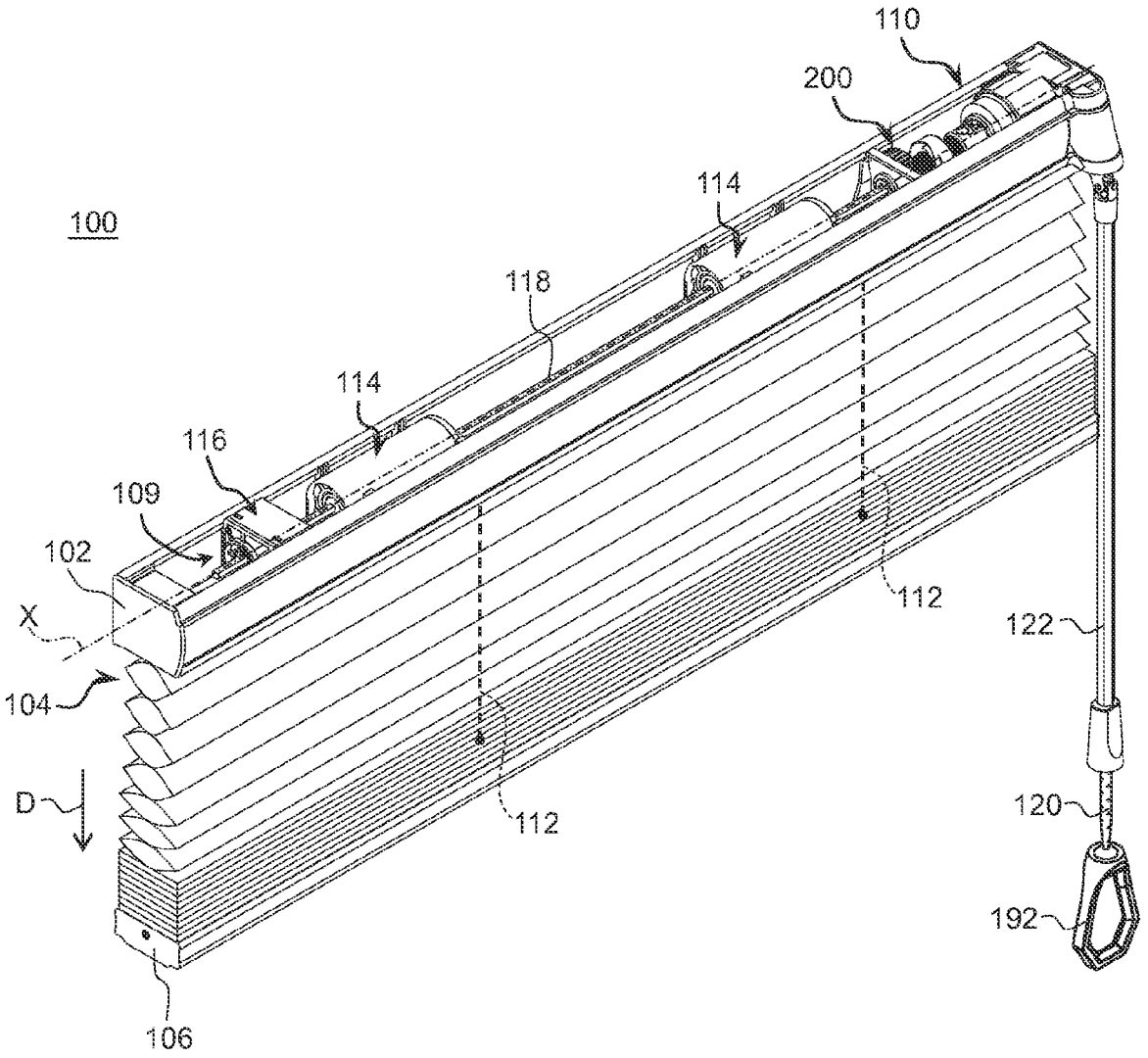
FIG. 18 is a schematic view illustrating an operation for lowering the window shade.
Figure 19:
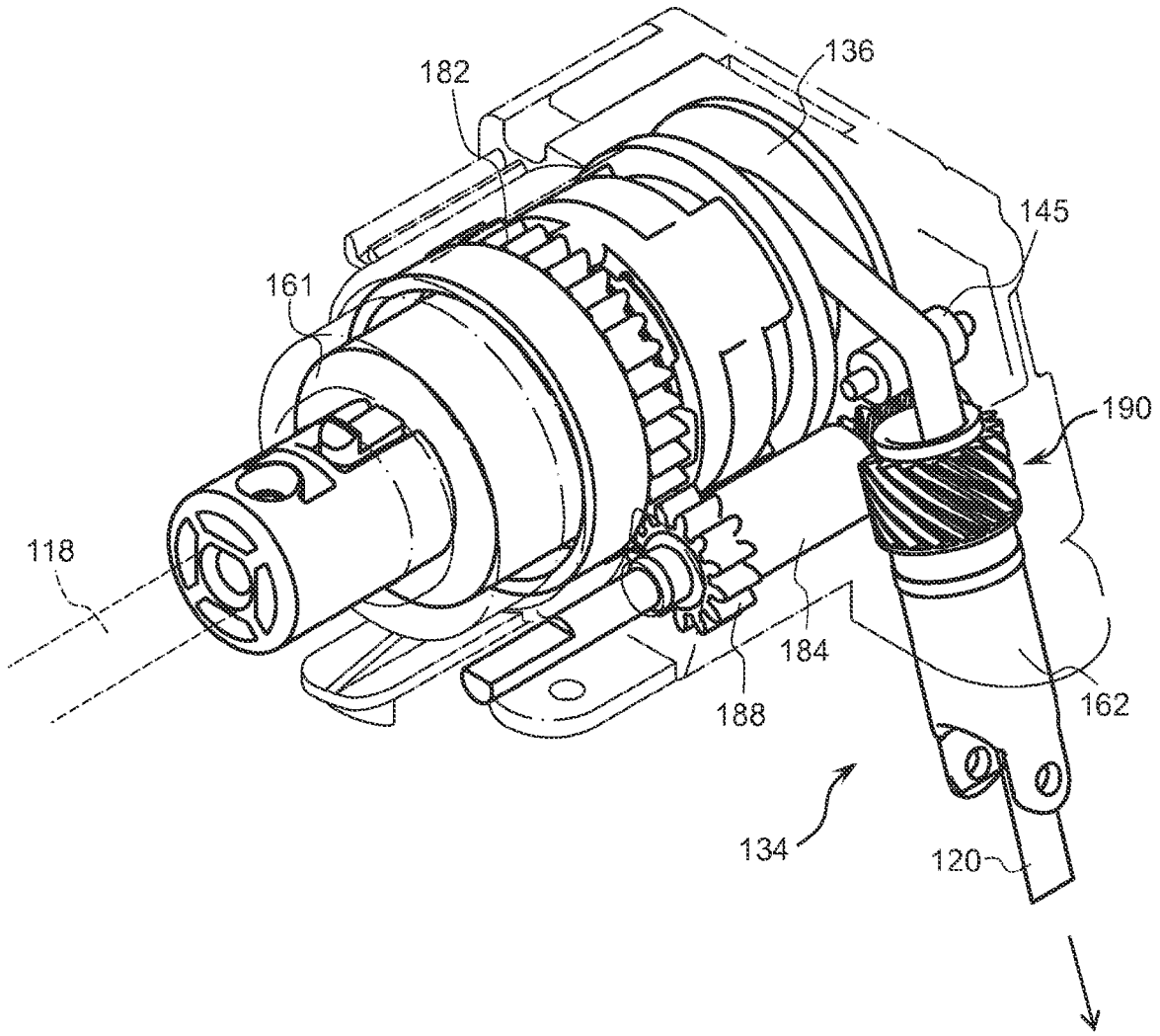
FIG. 19 is a schematic view illustrating the control module when the window shade lowers.
Figure 20:
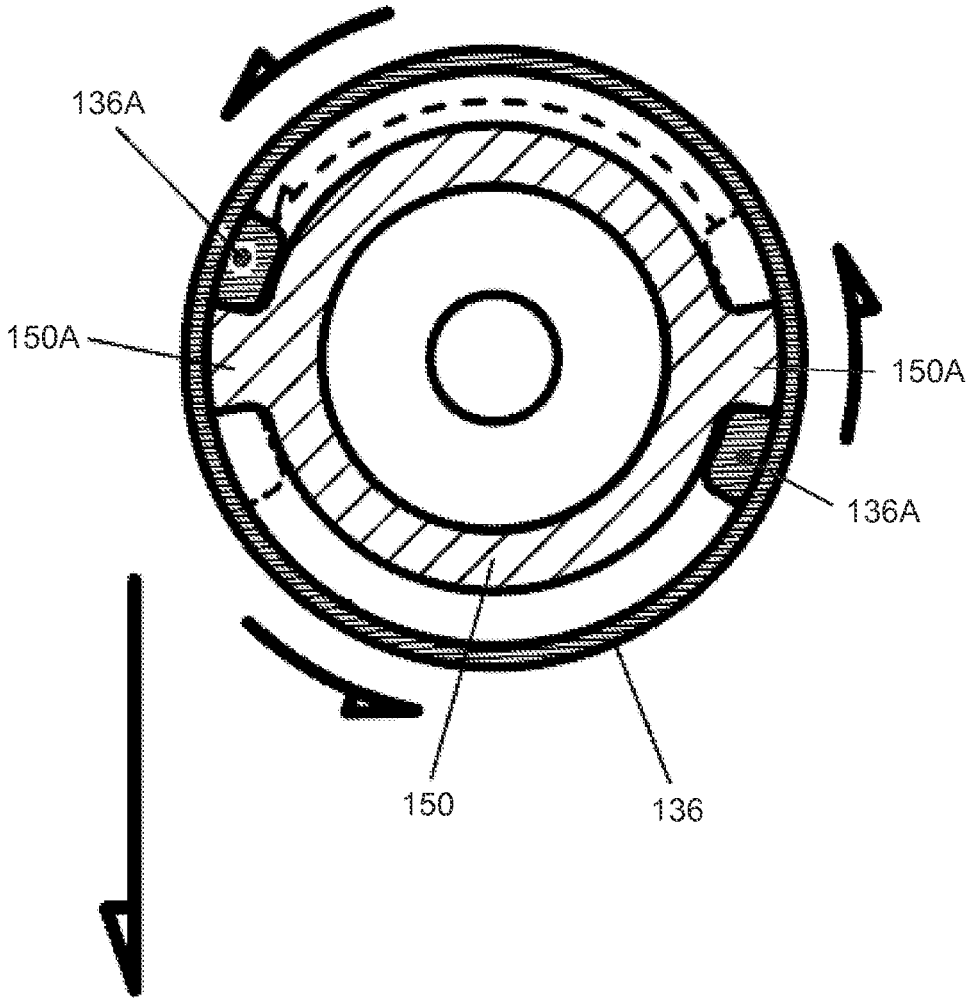
FIG. 20 is a partial cross-sectional view illustrating a configuration of the cord drum and the first coupling part in the control module when the window shade lowers.
Figure 21:
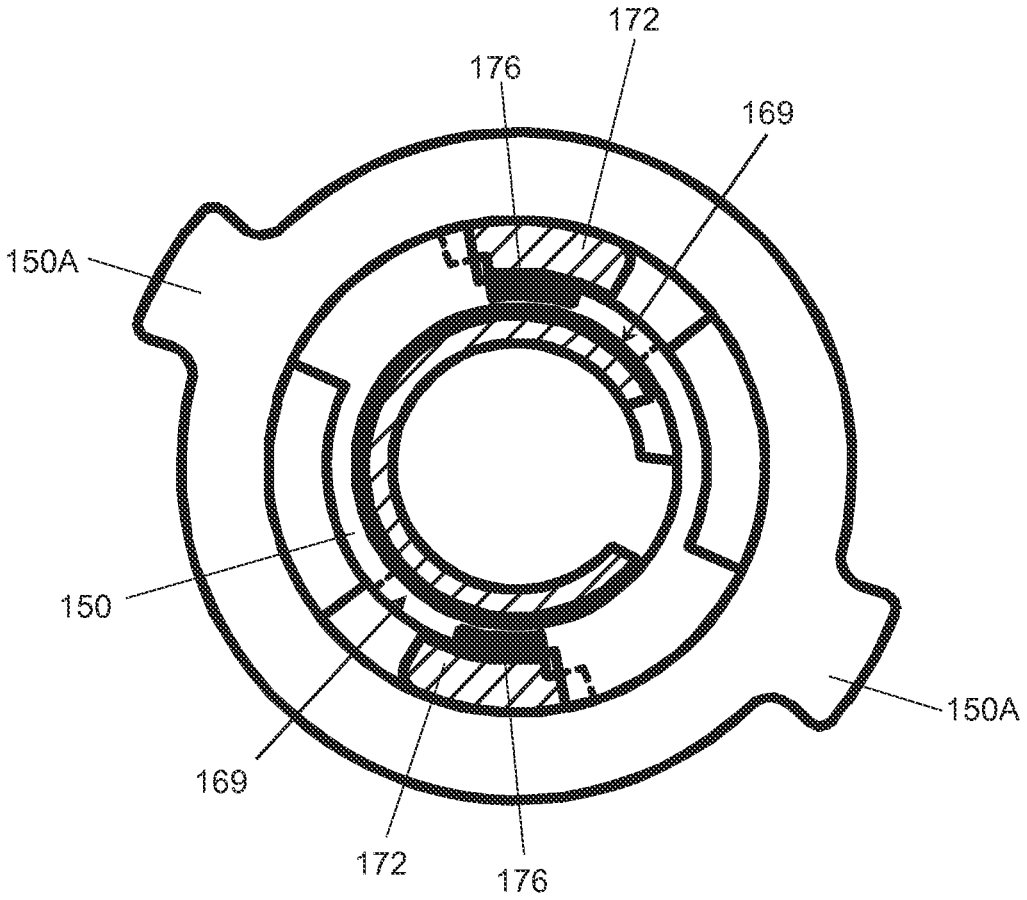
FIG. 21 is a partial cross-sectional view illustrating a configuration of the first and second coupling parts in the control module when the window shade lowers.

FIGS. 18-23 are schematic views illustrating an operation for lowering the window shade 100. Referring to FIG. 18, when a user wants to lower the bottom part 106, the plug 192 and the operating cord 120 can be pulled downward, which causes the operating cord 120 to unwind from the cord drum 136 and travel through the interior of the actuator 122 which is kept generally stationary. As shown in FIG. 20, the cord drum 136 can thereby rotate in a second direction opposite to the first direction for unwinding the operating cord 120, and the radial flange 136A of the rotating cord drum 136 can push against one radial flange 150A of the first coupling part 150. As a result, the first coupling part 150 can rotate relative to the second coupling part 152, until the radial abutment 168 of the first coupling part 150 can contact with the radial rib 172 of the second coupling part 152 (as better shown in FIG. 21). In this configuration, the second coupling part 152 can be in a second position relative to the first coupling part 150 where stop regions 177 are formed in the guide track 164 (as better shown in FIGS. 22 and 23).

As the operating cord 120 is continuously pulled downward, the cord drum 136 and the coupling and decoupling device 138 can rotate synchronously until the rolling part 160 reaches one stop region 177. It is worth noting that the illustrated embodiment can form two stop regions 177 in the guide track 164 so as to shorten the course of the rolling part 160 to the next stop region 177. However, alternate embodiments can also have the guide track 164 formed with a single stop region 177.

When the rolling part 160 reaches one stop region 177, the coupling and decoupling device 138 can be turned to the coupling state. Since the rolling part 160 concurrently engages with the stop region 177 and the radial slot 179 of the sleeve 161, further downward pulling of the operating cord 120 can drive the cord drum 136 in rotation. Owing to the contact between the radial flanges 136A and 150A, the rotation of the cord drum 136 can be transmitted to the coupling and decoupling device 138, which in turn can transmit the rotation to the sleeve 161 and the transmission axle 118 via the engagement of the rolling part 160 with the radial slot 179 of the sleeve 161 and the stop region 177 in the coupling and decoupling device 138. Accordingly, the transmission axle 118 and the sleeve 161 can rotate in the same second direction as the cord drum 136 for lowering the bottom part 106 as schematically shown by arrow D in FIG. 18. As the sleeve 161 and the transmission axle 118 rotate in the second direction for lowering the bottom part 106, the first prong 180A of the spring 180 can come in abutment against an inner surface of the housing 142, which can cause the spring 180 to switch from the state tightening on the sleeve 161 to the loosening state, thereby turning the arrester 132 to a release state. Accordingly, by pulling the operating cord 120 downward, the coupling and decoupling device 138 can be switched to the coupling state in which rotational displacement can be transmitted from the cord drum 136 through the coupling and decoupling device 138 to the sleeve 161 and the transmission axle 118, such that the cord drum 136, the sleeve 161 and the transmission axle 118 can overcome the lifting spring action exerted by the spring drive unit 116 and rotate concurrently in the second direction for unlocking the arrester 132 and lowering the bottom part 106.

While the bottom part 106 is moving downward, the user can release the operating cord 120 at any time, e.g., when the bottom part 106 reaches a desired height or after the operating cord 120 has been entirely unwound from the cord drum 136. When the operating cord 120 is released, the spring 180 can recover its tightening state around the sleeve 161. The tightening action of the spring 180 can act against the lift action applied by the spring drive unit 116 to lock and block rotation of the sleeve 161 and the transmission axle 118, whereby the shading structure 104 can be held at the desired height. At the same time, the spring 140 can urge rotation of the cord drum 136 to wind the operating cord 120.

Figure 24:
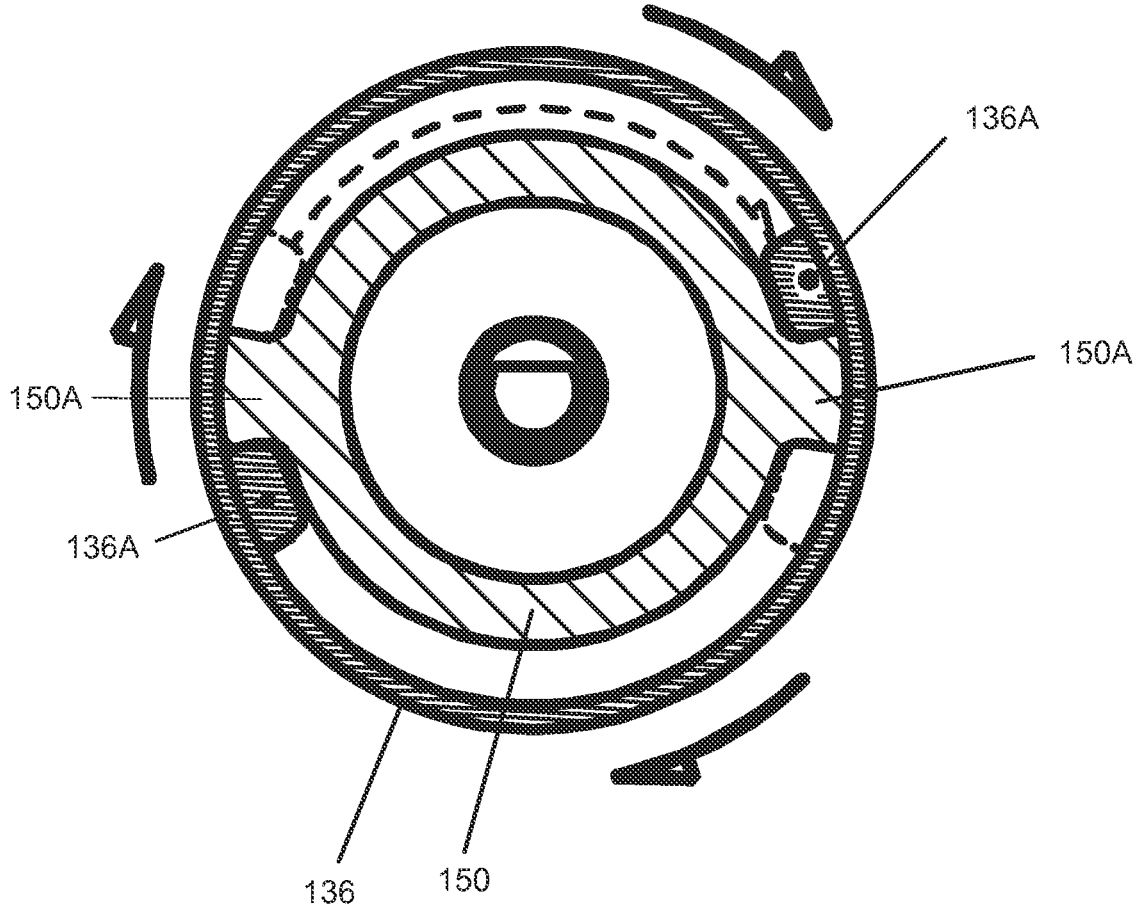
FIG. 24 is a partial cross-sectional view illustrating the interaction between the first coupling part and the cord drum in the control module during winding of the operating cord.

Referring to FIG. 24, as the cord drum 136 rotates reversely for winding the operating cord 120, the radial flange 136A of the cord drum 136 can contact and push against the opposing radial flange 150A of the first coupling part 150, whereby the first coupling part 150 can be synchronously driven to rotate relative to the second coupling part 152.

Figure 25:
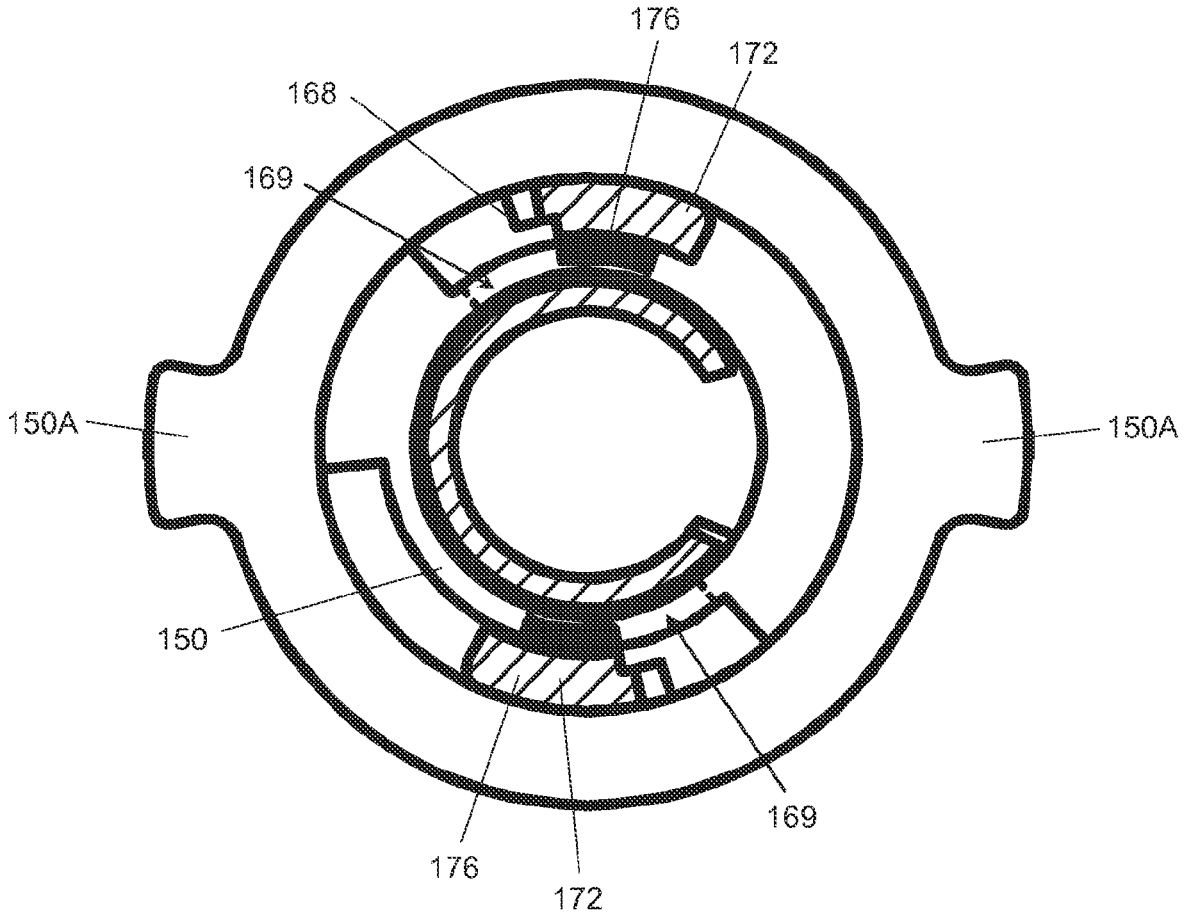
FIG. 25 is a partial cross-sectional view illustrating the first and second coupling parts in the control module when the cord drum winds the operating cord.
Figure 26:
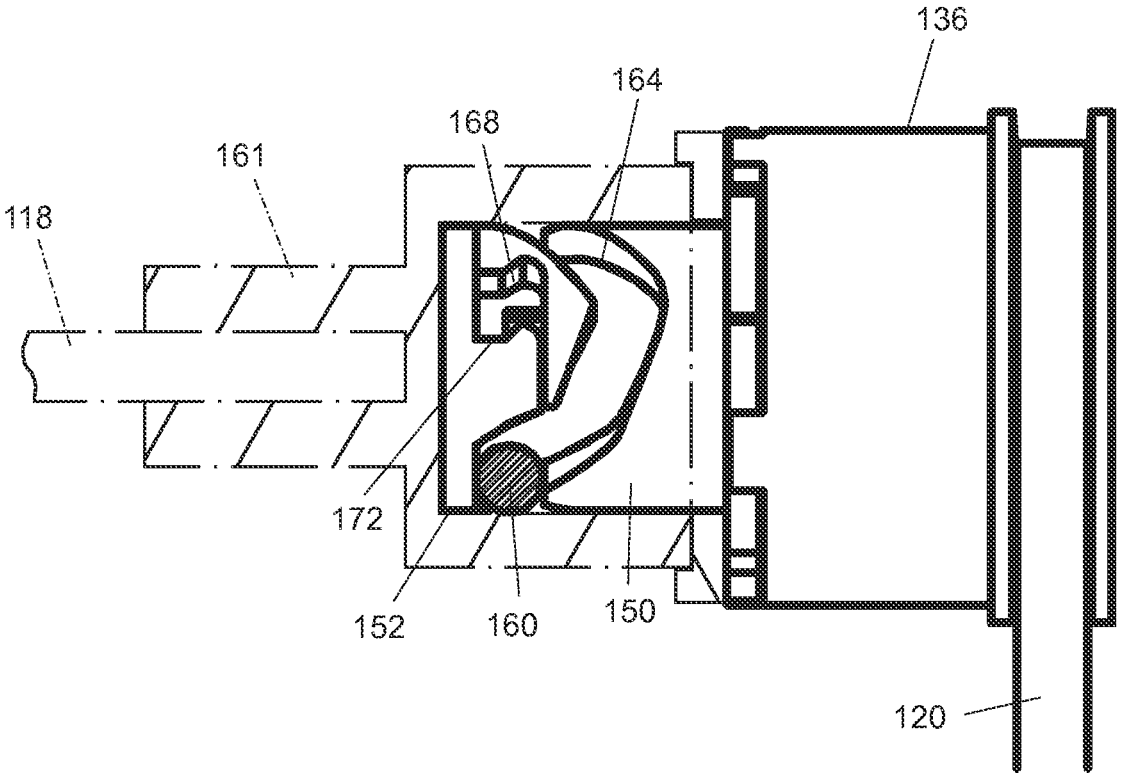
FIG. 26 is a schematic view illustrating a portion of the control module when the cord drum winds the operating cord.
Figure 27:
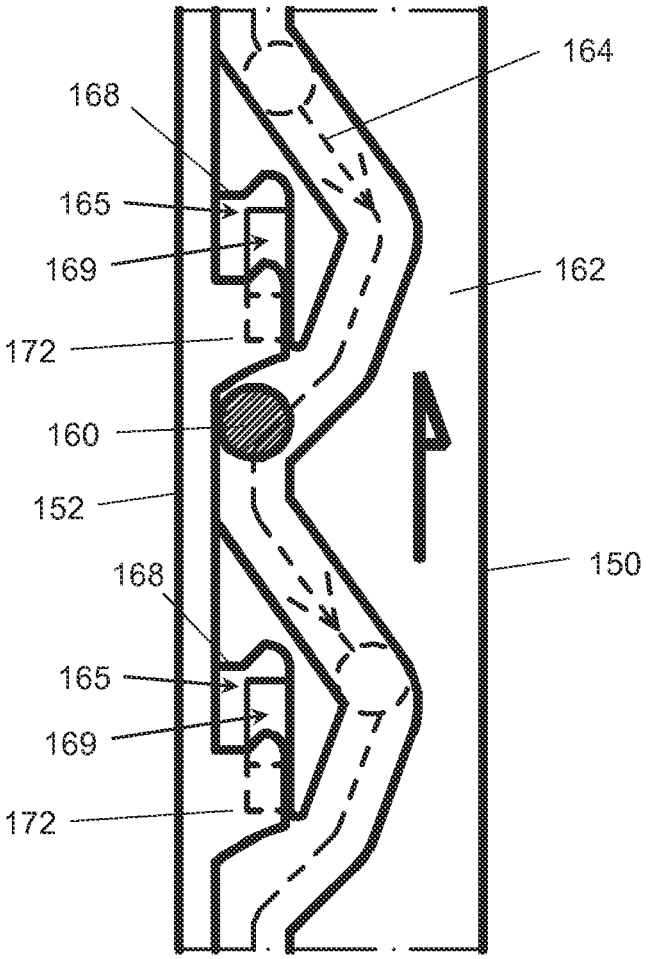
FIG. 27 is a schematic view illustrating a configuration of the guide track in the coupling and decoupling device when the cord drum winds the operating cord.

Referring to FIGS. 25-27, the rotation of the first coupling part 150 and the cord drum 136 can result in each radial abutment 168 of the first coupling part 150 to move away from the radial rib 172 adjacent thereto, until the first coupling part 150 reaches another abuttal position where no stop regions 177 are formed in the guide track 164 (as schematically shown in FIGS. 26 and 27). As exemplary shown in FIG. 7, once the extension 176 abuts against a side edge 169A of the slot 169, the guide track 164 can recover a configuration with no stop regions 177, and the coupling and decoupling device 138 can be turned to the decoupling state. Accordingly, the spring 140 can continue driving the cord drum 136 to rotate reversely for winding the operating cord 120, whereas the first and second coupling parts 150 and 152 can rotate synchronously. Because no stop regions 177 are formed in the guide track 164, the coupled rotation of the first and second coupling parts 150 and 152 can cause the rolling part 160 to slide along the guide track 164 and the radial slot 179 of the sleeve 161. As the first and second coupling parts 150 and 152 and the cord drum 136 rotate to wind the operating cord 120, the sleeve 161 and the transmission axle 118 can be kept in a stationary state owing to the locking action exerted by the spring 180, which can counteract the force difference between the raising force imparted by the spring drive unit 116 and the weight of the shading structure 104 and the bottom part 106. Therefore, the rotary drums 117 of the cord winding units 114 can remain stationary, and the bottom part 106 and the shading structure 104 can be respectively kept stationary in their current position while the cord drum 136 is winding the operating cord 120. After the cord drum 136 has wound partially or entirely the operating cord 120 (the plug 192 can abut against a lower end of the actuator 122 when the cord drum 136 entirely winds the operating cord 120), the user can pull again the operating cord 120 downward to lower the bottom part 106 and the shading structure 104. The aforementioned operating steps can be repeated multiple times, until the shading structure 104 lowers to a desirable height.

It is worth noting that while the operating cord 120 can be pulled to lower the shading structure 104 and the bottom part 106, it may also be possible for a user to lower the shading structure 104 by grasping the bottom part 106 and directly pulling it downward. The downward force thereby applied at the bottom part 106 can overcome the lift action exerted by the spring drive unit 116 and the locking action of the arrester 132, so that the suspension cords 112 can respectively unwind from the cord winding units 114 and cause rotation of the transmission axle 118 and the sleeve 161.

Figure 28:
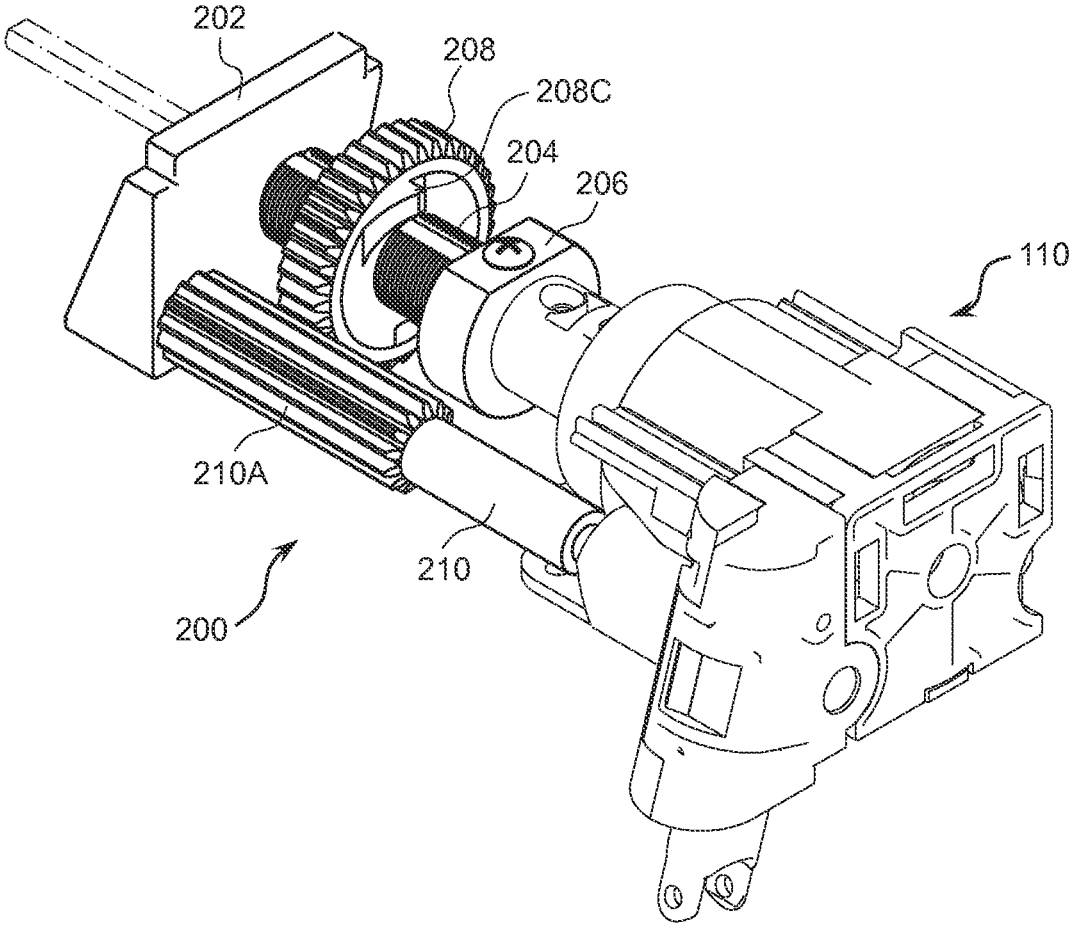
FIG. 28 is a perspective view illustrating a limit mechanism provided in the actuating system of the window shade shown in FIG. 1.
Figure 29:
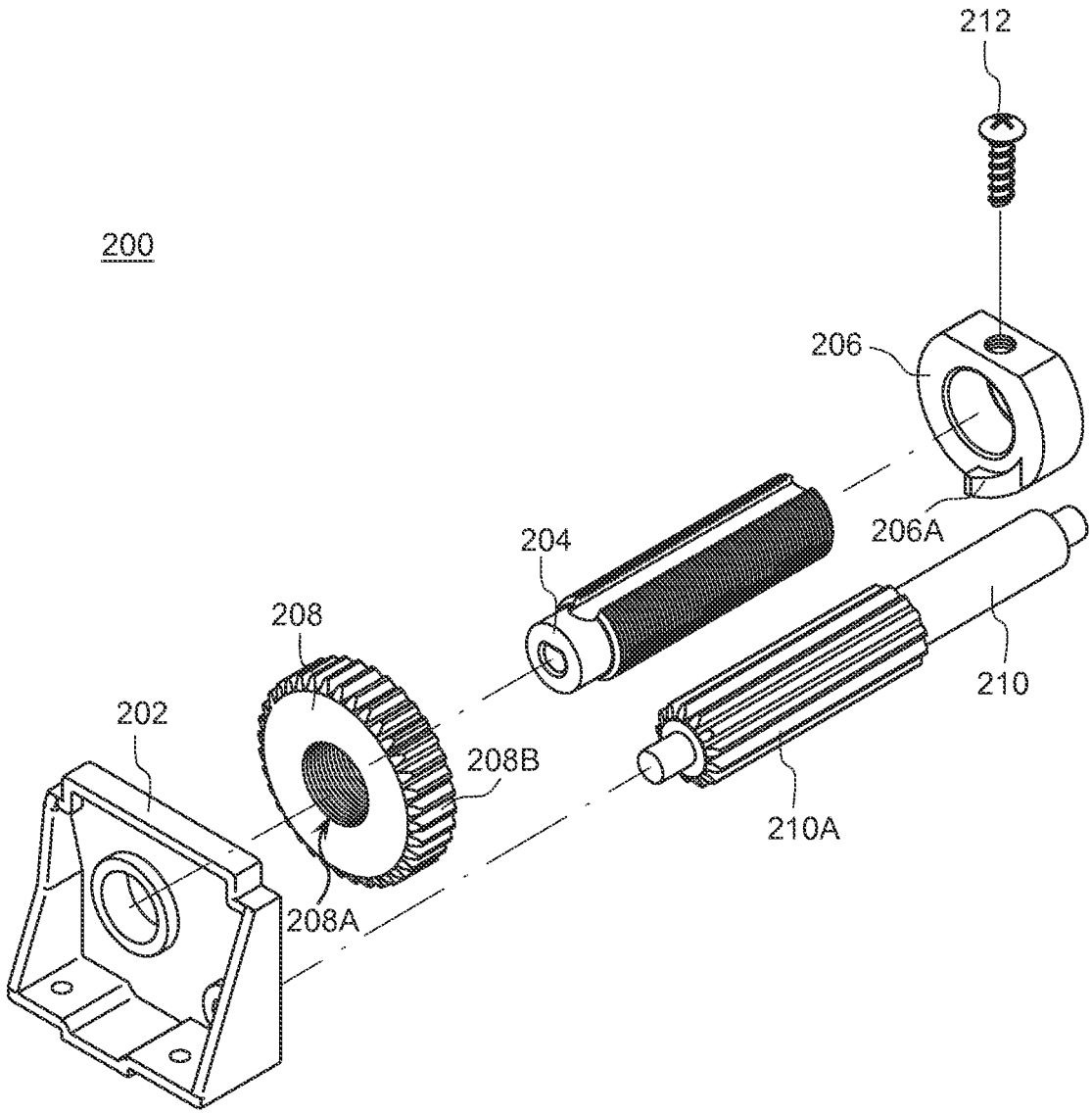
FIG. 29 is an exploded view of the limit mechanism.

In conjunction with FIG. 1, FIGS. 28 and 29 are schematic views illustrating a limit mechanism 200. The limit mechanism 200 can be disposed in the head rail 102 adjacent to the control module 110, and can be coupled with the transmission axle 118. The limit mechanism 200 can be operable to stop the bottom part 106 at a lowest position of its vertical course relative to the head rail 102, and prevent the bottom part 106 from reversely moving upward after reaching the lowest position. The mechanism 200 can include a support bracket 202, a screw 204, a stop member 206 affixed with the screw 204, a gear member 208 assembled with the screw 204, and a rod 210 having a toothed portion 210A. The support bracket 202 can be affixed in the head rail 102. The screw 204 can be affixed with the transmission axle 118 at a location adjacent to the sleeve 161, and can be pivotally connected with the support bracket 202. Rotation of the transmission axle 118 can thereby drive synchronously the screw 204 in rotation. The stop member 206 can be affixed with the screw 204 via a fastener 212, and can have a tooth 206A projecting along the axis of the screw 204 from a sidewall of the stop member 206 toward the gear member 208. The gear member 208 can have a threaded hole 208A through which the screw 204 is engaged, a peripheral gear portion 208B engaged with the toothed portion 210A of the rod 210, and a tooth 208C projecting along the axis of the threaded hole 208A from a sidewall of the gear member 208 toward the stop member 206. The rod 210 can be supported between the support bracket 202 and the housing 142 of the control module 110.

Any rotation of the transmission axle 118 can drive concurrent rotation of the screw 204 and the stop member 206 in the same direction. Owing to the respective engagement of the gear member 208 with the screw 204 and the rod 210, any rotation of the screw 204 can cause the gear member 208 to gradually move axially either toward or away from the stop member 206.

Figure 30:
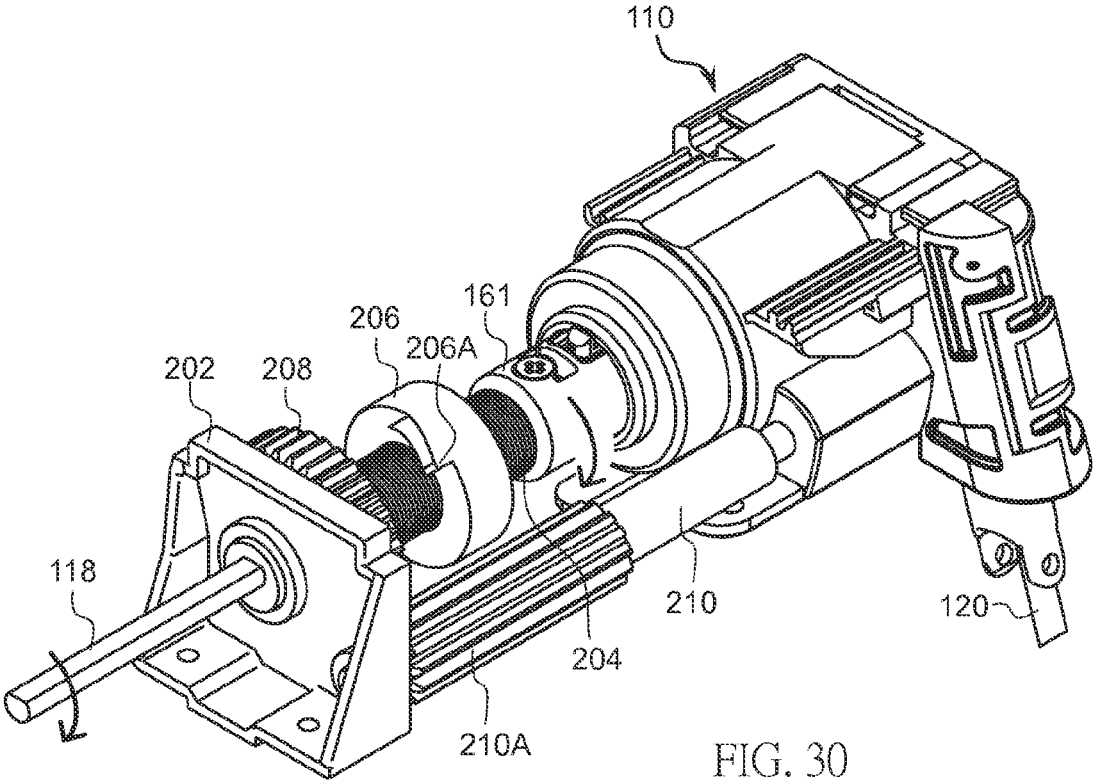
FIG. 30 is a schematic view illustrating an operation of the limit mechanism when the window shade lowers.
Figure 31:
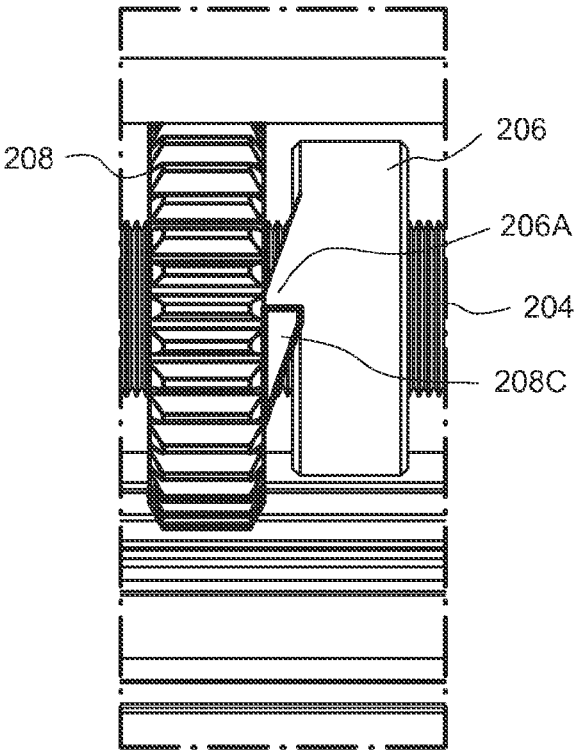
FIG. 31 is a schematic view illustrating a locking engagement of the limit mechanism when the window shade reaches a lowest position.

Referring to FIGS. 30 and 31, a rotation of the transmission axle 118 in the second direction for lowering the bottom part 106 can drive the gear member 208 to move axially along the screw 204 toward the stop member 206, whereas the rod 210 remains stationary. Once the tooth 208C of the gear member 208 engages with the tooth 206A of the stop member 206 as shown in FIG. 31, the screw 204 and the transmission axle 118 cannot further rotate in the second direction to further lower the bottom part 104, which can be thereby stopped at a lowest position.

In contrast, a rotation of the transmission axle 118 in the first direction for raising the bottom part 106 can cause concurrent rotation of the screw 204 in the first direction, which in turn drives the gear member 208 to move axially away from the stop member 206 and toward the support bracket 202. While the gear member 208 moves axially toward the support bracket 202, the rod 210 is kept stationary. It is noted that the rotation of the gear transmission member 184 owing to operation of the actuator 122 for raising the bottom part 106 can also drive a rotational displacement of the rod 210, which in turn can drive a slight rotation of the gear member 208.

With the structures and operating methods described herein, the arrester of the control module can be turned from the locking state to the release state by rotating an actuator, whereby the shading structure can be raised without effort by the spring drive unit. Moreover, the operating cord can be simply pulled downward to drive rotation of the transmission axle, which unlocks the arrester and overcomes the spring force of the spring drive unit for lowering the shading structure. The window shade described herein thus can be convenient to operate.

Realizations of the structures and methods have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the claims that follow.

What is claimed is:

1. An actuating system for a window shade, comprising:

a transmission axle;

a spring drive unit operable to urge the transmission axle to rotate in a first direction for raising a shading structure of the window shade; and a control module including an arrester assembled around the transmission axle, an operating cord operatively connectable with the transmission axle, and a release unit having an actuator operatively connected with the arrester, the actuator having an elongated shape extending along a lengthwise axis, and the operating cord extending through an interior of the actuator;

the arrester having a locking state in which the arrester acts against the spring drive unit to block a rotational displacement of the transmission axle in the first direction, and an unlocking state in which rotation of the transmission axle is allowed;

the operating cord being operable to turn the arrester from the locking state to the unlocking state and to drive rotation of the transmission axle in a second direction opposite to the first direction for lowering the shading structure of the window shade; and the actuator being operable to rotate about the lengthwise axis to drive the arrester to switch from the locking state to the unlocking state.

2. The actuating system according to claim 1, wherein the spring drive unit includes a torsion spring operatively connected with the transmission axle.

3. The actuating system according to claim 1, wherein the operating cord is operable to drive rotation of the transmission axle in the second direction against a spring force applied by the spring drive unit on the transmission axle.

4. The actuating system according to claim 1, wherein the transmission axle is affixed with a sleeve, and the arrester includes a spring mounted around the sleeve, the spring tightening on the sleeve when the arrester is in the locking state, and the spring loosening when the arrester is in the unlocking state.

5. The actuating system according to claim 4, wherein the release unit further includes:

a collar operable to rotate about a rotation axis of the transmission axle; and a plurality of transmission members connected between the collar and the actuator, wherein a rotation of the actuator about the lengthwise axis is transmitted via the transmission members and drives a rotational displacement of the collar about the rotation axis to cause the spring to loosen.

6. The actuating system according to claim 1, wherein the actuator is a hollow stick, and the operating cord extends through an interior of the stick.

7. The actuating system according to claim 1, wherein the control module further includes:

a cord drum connected with the operating cord; and a coupling and decoupling device connected with the arrester and the cord drum;

wherein a pulling action on the operating cord drives the cord drum to rotate and turns the coupling and decoupling device to a coupling state, whereby rotation of the cord drum is transmitted through the coupling and decoupling device in the coupling state to drive the transmission axle to rotate in the second direction.

8. The actuating system according to claim 7, wherein the cord drum, the coupling and decoupling device, and the spring drive unit are assembled coaxially about the axis of the transmission axle.

9. The actuating system according to claim 8, wherein the coupling and decoupling device is maintained in a decoupling state when the transmission axle rotates in the second direction, whereby the cord drum remains stationary when the transmission axle rotates in the second direction.

10. The actuating system according to claim 9, wherein the cord drum is further connected with a spring, the spring being operable to cause rotation of the cord drum for winding the operating cord around the cord drum.

11. The actuating system according to claim 10, wherein the transmission axle is affixed with a sleeve, the arrester includes a spring assembled around the sleeve, the spring tightening on the sleeve when the arrester is in the locking state, the spring loosening when the arrester is in the unlocking state, and a pulling action on the operating cord causes the spring to turn to the unlocking state.

12. The actuating system according to claim 11, wherein the release unit further includes:

a collar operable to rotate around a rotation axis of the transmission axle; and a plurality of transmission members connected between the collar and the actuator, wherein the actuator is rotatable about the lengthwise axis so as to drive a rotational displacement of the collar about the rotation axis of the transmission axle to cause the spring to loosen.

13. The actuating system according to claim 12, wherein the transmission members include a first and a second transmission member, the collar has a toothed portion that engages with the first transmission member, and the second transmission member is connected with the actuator and engages with the first transmission member via a gear transmission.

14. The actuating system according to claim 13, wherein the second transmission member has a hollow body, and the operating cord extends through the second transmission member and the actuator.

15. A window shade comprising:

a head rail;

a shading structure;

a bottom part disposed at a lowermost end of the shading structure;

at least one suspension cord connected with the head rail and the bottom part;

at least one cord winding unit assembled with the head rail and connected with the suspension cord; and the actuating system according to claim 1 assembled with the head rail, wherein the transmission axle is connected with the cord winding unit, the rotation of the transmission axle in the first direction causing the cord winding unit to wind the suspension cord for raising the bottom part, and the rotation of the transmission axle in the second direction causing the suspension cord to unwind from the cord winding unit for lowering the bottom part.

16. The window shade according to claim 15, further including a limit mechanism coupled with the transmission axle, the limit mechanism being operable to stop the bottom part at a lowest position relative to the head rail.

17. The window shade according to claim 16, wherein the limit mechanism includes:

a screw affixed with the transmission axle;

a stop member affixed with the screw; and a gear member having a threaded hole through which is engaged the screw, wherein the rotation of the transmission axle in the second direction causes the gear member to move axially along the screw toward the stop member.

18. An actuating system for a window shade, comprising:

a transmission axle;

a spring drive unit operable to urge the transmission axle to rotate in a first direction for raising a shading structure of the window shade; and a control module including an arrester assembled around the transmission axle, an operating cord operatively connectable with the transmission axle, and a release unit having an actuator operatively connected with the arrester, the actuator having an elongated shape extending along a lengthwise axis;

the arrester having a locking state in which the arrester acts against the spring drive unit to block a rotational displacement of the transmission axle in the first direction, and an unlocking state in which rotation of the transmission axle is allowed;

the operating cord being pulled downward to turn the arrester from the locking state to the unlocking state and to drive rotation of the transmission axle in a second direction opposite to the first direction for lowering the shading structure of the window shade; and the actuator being operable to rotate about the lengthwise axis to drive the arrester to switch from the locking state to the unlocking state.

19. The actuating system according to claim 18, wherein the actuator is a hollow stick, and the operating cord extends through an interior of the stick.

20. The actuating system according to claim 18, wherein the transmission axle is affixed with a sleeve, the arrester includes a spring assembled around the sleeve, the spring tightening on the sleeve when the arrester is in the locking state, the spring loosening when the arrester is in the unlocking state, and a pulling action on the operating cord causes the spring to loosen.

21. The actuating system according to claim 20, wherein the release unit further includes:

a collar operable to rotate around a rotation axis of the transmission axle; and a plurality of transmission members connected between the collar and the actuator, wherein the actuator is rotatable about the lengthwise axis so as to drive a rotational displacement of the collar about the rotation axis of the transmission axle to cause the spring to loosen.

22. The actuating system according to claim 21, wherein the transmission members include a first and a second transmission member, the collar has a toothed portion that engages with the first transmission member, and the second transmission member is connected with the actuator and engages with the first transmission member via a gear transmission.

* * * * *